US005090070A

United States Patent [19]

Heinz

[11] Patent Number: 5,090,070

[45] Date of Patent: Feb. 25, 1992

[54] VARIABLE HEIGHT BED

[75] Inventor: David S. Heinz, Hay Lakes, Canada

[73] Assignee: University of Alberta Hospitals, Alberta, Canada

[21] Appl. No.: 596,079

[22] Filed: Oct. 11, 1990

[30] Foreign Application Priority Data

Jul. 11, 1990 [CA] Canada ..... 2020880

[51] Int. Cl.[5] ..... A61G 7/00

[52] U.S. Cl. ..... 5/611; 5/64; 5/430; 5/313.1

[58] Field of Search ..... 5/62, 63, 64, 65, 66, 5/425, 430, 11, 310, 313.1

[56] References Cited

U.S. PATENT DOCUMENTS

| | | | |
|---|---|---|---|
| 1,890,177 | 12/1932 | Derry . | |
| 2,280,444 | 4/1942 | Neunherz . | |
| 3,050,745 | 8/1962 | Tabbert | 5/63 |
| 3,267,493 | 8/1966 | Pruim | 5/63 |
| 3,305,876 | 2/1967 | Hutt . | |
| 3,348,893 | 10/1967 | Katzfey | 5/63 |
| 3,526,008 | 9/1970 | Pruim | 5/430 |
| 3,887,950 | 6/1975 | Wachsman . | |
| 3,919,727 | 11/1975 | Paine . | |
| 3,987,503 | 10/1976 | Kean . | |
| 4,057,240 | 11/1977 | Damico et al. . | |
| 4,231,124 | 11/1980 | Croxton | 5/63 |
| 4,271,830 | 6/1981 | Moon . | |
| 4,345,344 | 8/1982 | Gadoury | 5/63 |
| 4,398,313 | 8/1983 | Mitchell . | |
| 4,472,845 | 9/1984 | Chivetta | 5/63 |
| 4,556,198 | 12/1985 | Tominaga . | |
| 4,669,136 | 6/1987 | Waters | 5/185 |
| 4,865,159 | 8/1987 | Oetiker | 5/63 |

FOREIGN PATENT DOCUMENTS

| | | | |
|---|---|---|---|
| 49870 | 1/1972 | Australia | 5/63 |
| 843652 | 6/1970 | Canada | 5/63 |
| 980053 | 12/1975 | Canada . | |
| 2525596 | 12/1976 | Fed. Rep. of Germany . | |
| 2628164 | 1/1977 | Fed. Rep. of Germany . | |
| 3516092 | 11/1986 | Fed. Rep. of Germany . | |
| 3618249 | 12/1987 | Fed. Rep. of Germany . | |
| 152451 | 11/1973 | Netherlands . | |
| 156655 | 8/1952 | Sweden | 5/63 |
| 1410034 | 10/1975 | United Kingdom . | |

*Primary Examiner*—Gary L. Smith
*Assistant Examiner*—F. Saether
*Attorney, Agent, or Firm*—Stevens, Davis, Miller & Mosher

[57] ABSTRACT

A variable height bed for use in hospitals, extended care facilities and the like. The bed incorporates a base or stationary frame and an elevating frame interconnected and nesting with the stationary frame. The elevating frame has an operative range of about twenty inches, from a minimum height of approximately ten inches above the floor to a maximum of approximately twenty nine inches above the floor. The bed structure provides for substantial clearance under its midsection and includes means for elevating without the use of a manual cranking operation. Guard rails located along the sides of the bed can be moved completely out of the way of the bed sides when required; and means are provided for immobilizing the bed at any location of the elevating frame.

19 Claims, 23 Drawing Sheets

VARIABLE HEIGHT BED

FIELD OF THE INVENTION

This invention relates to beds of the type used in institutions such as hospitals, extended care facilities and the like and to a bed structure which is variable in height.

BACKGROUND OF THE INVENTION

Variable height beds of the type to which the present invention is related, have been known for some time. Examples of the prior art may be found in U.S. Pat. No. 4,271,830 Moon of June 9, 1981; U.S. Pat. No. 2,280,444 Neunherz, Apr. 21, 1942 and U.S. Pat. No. 3,305,876 Hutt, Feb. 28, 1967 and U.S. Pat. No. 1,890,177 Derry, Dec. 6, 1932.

Further examples of beds having a variable height features may be found in U.S. Pat. No. 4,398,313 Mitchell, Aug. 16, 1983; U.S. Pat. No. 4,556,198 Tominaga, Dec. 3, 1985 and U.S. Pat. No. 3,304,116 Stryker, Feb. 14, 1967.

While many of the above-mentioned patent specifications disclose desirable features, hospital research bodies and nursing staff are always striving to locate bed structures having the most functional features with respect to patient comfort, care and safety and ease of operation by attendant staff.

Beds used in general care areas of hospitals and long term care areas of extended care facilities and the like normally incorporate a multi-section mattress surface and the head and knee portions, generally referred to as gatches, must be able to tilt to different angles and the height of the bed should be variable.

The features most desired in a bed structure by nursing and attendant staff is a bed having a variable height supporting surface which can be lowered to a minimum height of approximately ten inches above the floor; a maximum height of approximately twenty-nine inches or more above the floor; substantial clearance under the midsection of the bed; means for elevating the support surface without having to resort to hand crank operation; guard rail structures which could be located totally out of the way of the sides of the support structure when those guard rails are not needed and some means to securely immobilize the bed against moving or shifting and which could be operable at any bed height.

Attempts to modify existing bed structures as generally known in the industry, were unsuccessful in meeting the above mentioned features and functions. A variety of problems arose when such modifications were attempted. For example, when the elevation of a bed in its lowermost position was decreased, the bed no longer rose high enough for other functions. Under-bed clearance space was lost and guard rails no longer were functional in the lowermost position. Moreover, head and knee gatch operating mechanisms hit the floor or supporting surface and the ability to tilt portions of the bed were no longer available. The lift operating cranks became too low to conveniently operate; and some designs, when modified, ended up being excessive in longitudinal movement.

Beds of the structure using an X-type or scissor form of lift have inherently very poor under-bed clearance when the bed is moved to its lowermost position. Such beds need to be raised to a considerable portion of their maximum height before achieving the desired under-bed clearance.

Considering for example the patent to Moon U.S. Pat. No. 4,271,830, the structure shown therein is a chiropractic table and does not have any castor wheels, guard rails or movable head and knee gatches. The integration of such units into the present invention is important and are required functional features in the area to which the invention relates. To attempt to modify a structure such as in the Moon patent to meet the above-mentioned functions and features would result in nothing short of a complete redesign of the Moon patent structure. For example, the table of the Moon patent has no clearance space underneath the structure and there is no easy means for making such modifications for such clearance. Certain parts for the elevating mechanism of the Moon device occupy this space. A further problem is that the table of the device in the Moon patent appears to be incapable of moving from a low elevation point of ten inches to a high elevation point of approximately twenty-nine inches.

SUMMARY OF THE INVENTION

The bed structure according to the present invention provides a unit which can be lowered in elevation to approximately ten inches and raised in elevation as high as twenty-nine inches while still providing clearance under the middle section of the bed after being raised slightly from its lowermost position. The framework, which can go as low as ten inches, is still able to tilt by sliding one frame-end on another for trendelenberg and reverse trendelenberg positions.

It is to be noted that the elevation figures of ten and twenty-nine inches apply to the top of the mattress support surface. The main structural part of the elevating frame is 1.5 inches lower than the top of the mattress support surface.

The bed has immobilizer legs which can be operated at any bed height even with a heavy occupant on the bed, and can provide a one inch clearance when in the off position and be positively either "on" or "off".

The bed incorporates a friction lock on a separable lift connecting rod in order to achieve the trendelenberg type of tilt and specific uses of compression struts reduce bed frame stresses.

The bed incorporates two frames, a base or stationary frame and an elevating frame. The frame members are arranged in such a way that they move past one another to "nest" rather than to form a stack. Operable equipment is moved away from the central area of the bed to provide the desired under-bed clearance and the lift actuating mechanism is therefore positioned on the ends of the structure rather than in the center.

The base or stationary frame rests upon the floor either through castors or immobilizer legs. The elevating frame is interconnected to the base or stationary frame through a lifting mechanism which can raise or lower the elevating frame. The lifting mechanism can be activated by various means such as foot pedals or by hand controls. A series of mattress support surfaces are located on the elevating frame so that the mattress can be raised or lowered to the desirable elevation. Several of the mattress support surfaces can be tilted to various angles for nursing needs and/or patient comfort. Hydraulic or electric actuators can be used to tilt the mattress surfaces.

The elevating frame is provided with two sets of lifting arms that form parallel links between the elevating frame and the stationary frame. An actuator is located such that it provides a contracting or tensioning force to the arms so as to rotate them and to thereby raise or lower the elevating frame with respect to the stationary frame.

Four immobilizer legs are provided and are operated by foot pedals hinged to the stationary frame. When moved to the mobile position, the immobilizer legs are raised about an inch above the floor to enable the bed to travel by castor means. When in the immobile position, the legs descend and contact the floor and raise the bed, including the castor means, about an eighth of an inch above the floor. This is done with one pedal stroke for each side of the bed.

The patient guard rails are collapsible to move them out of the way of the sides of the mattress areas. For some nursing and care situations, an initial stage of collapse is sufficient. However, where it is desired to move the rails completely away from the side edges of the mattress supporting surface, provision is made to rotate the entire collapsed guard rail to position it under the bed. It is to be appreciated that the guard rails of the bed according to the present invention can be operable to a working position or to stored position at any elevation of the bed.

The geometry of the two frame portions and its associated lift mechanism are such that two actuators can be used rather than a single one. The actuators can be so located together with bracket means to enable the bed to tilt in either of two ways, foot-up or head-up; i.e. trendelenberg and reverse trendelenberg positions.

According to a broad aspect, the invention relates to a variable height bed for use in hospitals and like facilities. The bed comprises a base or stationary frame having a castor foot adjacent each corner thereof, an elevating frame interconnected with the base frame and moveable in elevation with respect to the base frame. Frame elevating means are provided for effecting vertical movement of the elevating frame relative to the stationary frame and it includes linking means that are operated by the frame elevating means and which interconnect the stationary frame and the elevating frame to provide movement of the elevating frame from a lowermost elevation position of approximately ten inches above a supporting surface to an uppermost elevation position of approximately twenty-nine inches above a supporting surface. Head and knee gatch members are interconnected to one another and detachably secured to the upper surface of the elevating frame and means are provided for actuating the head and knee gatch members to angularly elevated or flat positions and independently of one another. Guard rail means are secured along each side of the elevating frame, each guard rail means comprising a lower rail which is secured to the elevating frame and an upper rail spaced therefrom and parallel thereto with a plurality of upright members interconnecting the upper and lower rails. Means are provided for diagonally collapsing the upper rail and upright members down onto the lower rail member and means are also provided for pivoting the collapsed guard rail from a position adjacent the side edge of the elevating frame to a position beneath the side edge of that frame.

BRIEF DESCRIPTION OF THE DRAWINGS

The invention is illustrated by way of example in the accompanying drawings in which.

DETAILED DESCRIPTION OF THE PREFERRED EMBODIMENT

Figure 1:
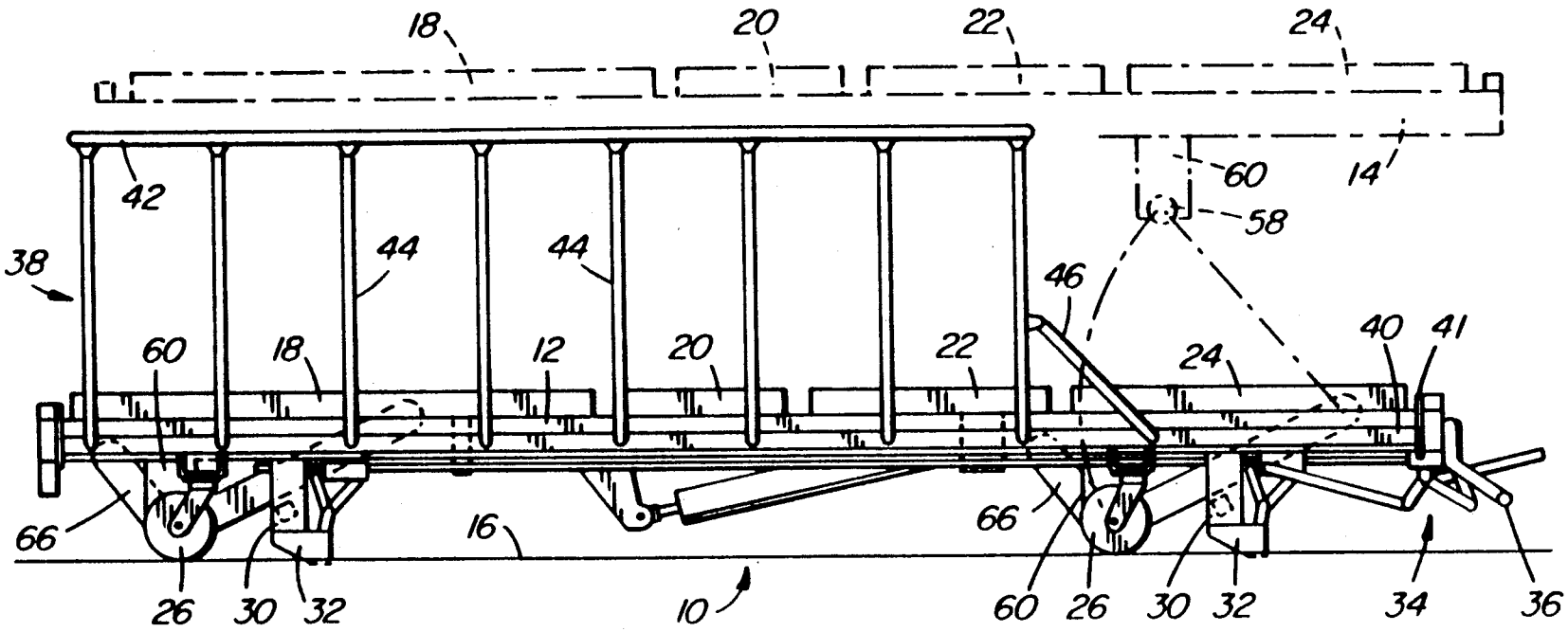
FIG. 1 is a side elevation of a complete bed assembly according to the present invention.
Figure 2:
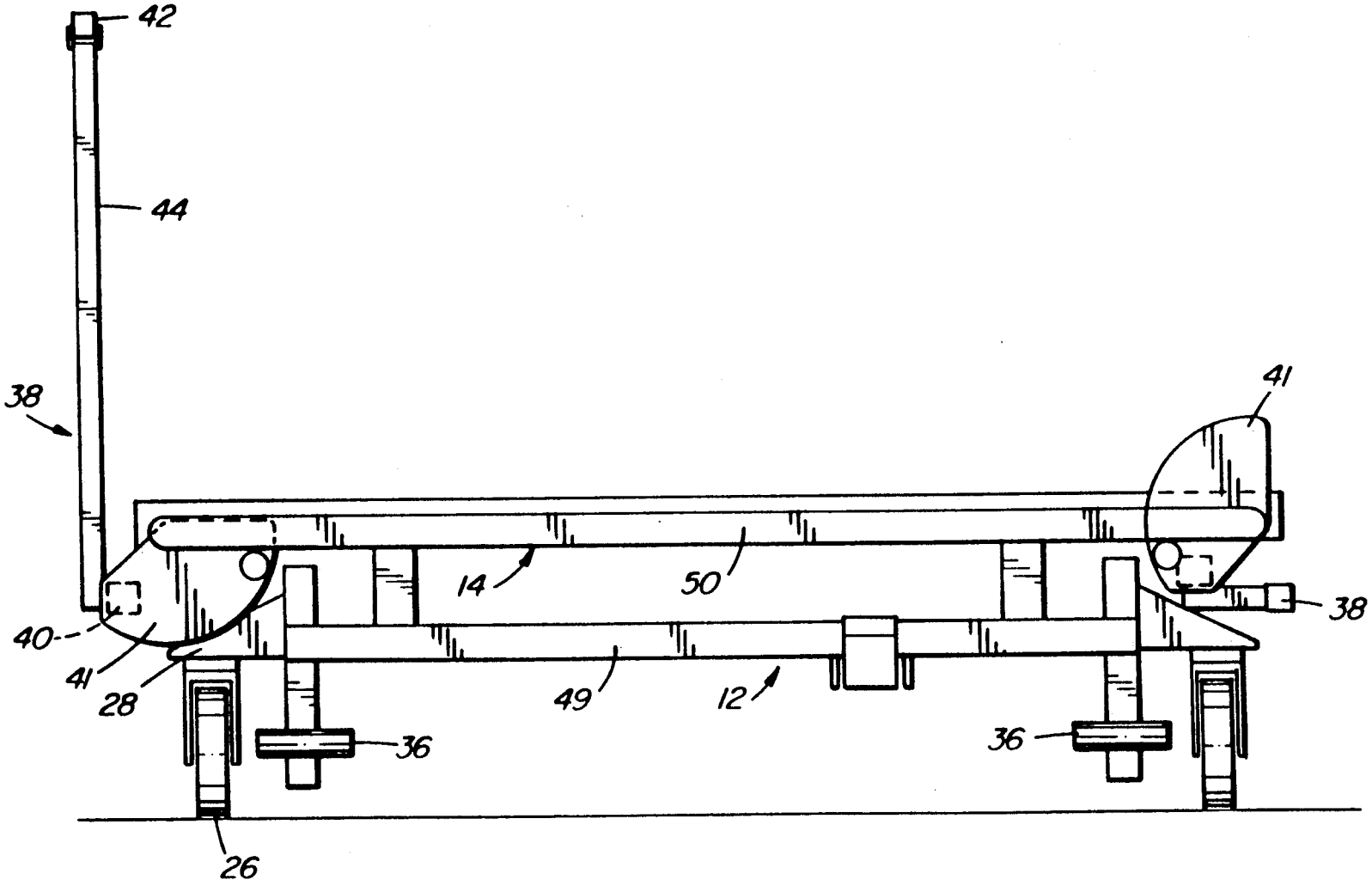
FIG. 2 is an end view of the bed structure of FIG. 1.
Figure 3:
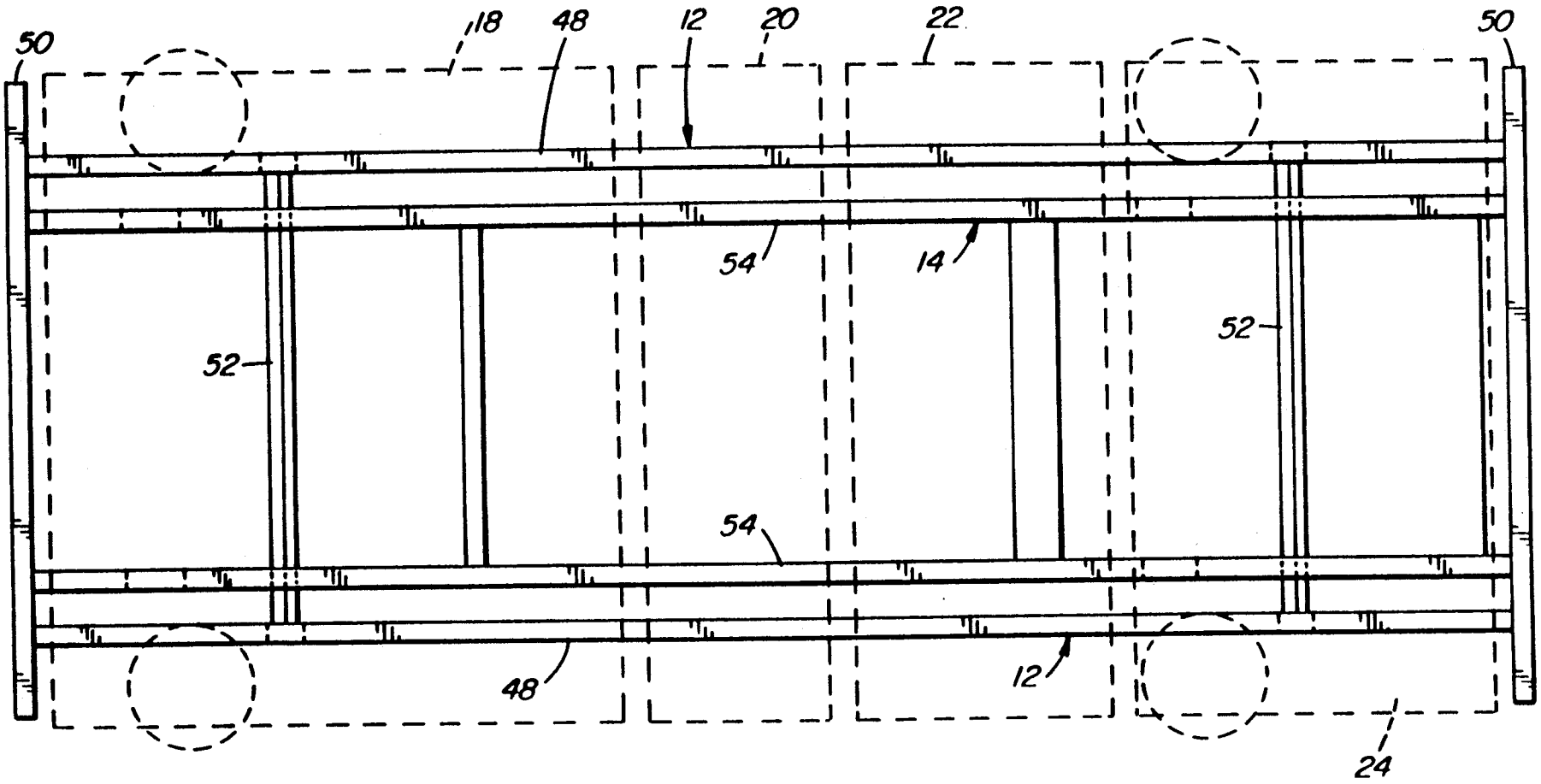
FIG. 3 is a plan view of the bed structure in FIG. 1.

Referring initially to FIGS. 1, 2 and 3 of the drawings, and in particular to FIG. 1, a variable height bed according to the invention is shown generally at 10 and it includes two frames, a base or stationary frame 12 and an elevating frame 14 which, as will be described hereinafter, can be moved to a lowermost elevation position, shown in FIGS. 1 and 2 in which the elevating frame is approximately 10 inches above the supporting surface or floor 16 to an uppermost elevation position shown in phantom line on FIG. 1. The elevating frame 14 supports a plurality of mattress sections or gatches 18, 20, 22 and 24, on its upper surface. Selected ones of these gatches may themselves be moved to angularly elevated positions as will be described later on in this specification. The stationary frame 12 is provided with castors mounted to the frame by brackets 28 and the castors are located along both sides of the stationary frame and inwardly of the ends thereof.

The head end of the bed is at the left hand side of FIGS. 1 and 3.

Means are provided for immobilizing the bed in the form of legs 30 having floor engaging feet 32 and which are operable by two sets of immobilizer assemblies indicated generally at 34 and made up of a series of linkages and operable by actuator pedals 36. The immobilizer leg assemblies will be described in detail with respect to FIGS. 15-17 but suffice it to say at this point that with the pedal 36 in the fully raised position, the feet 32 are pivoted upwardly so that they are free of the floor 16, allowing the bed to be moved around on its castors 26. Depressing the pedal 36 to its FIG. 1 position pivots the feet downwardly as illustrated to engage the floor surface. A further depression of the pedal 36 looks the feet 32 in their most downward position to raise the stationary frame and the complete bed structure to the point where the castor wheels are a fraction of an inch above the surface of the floor 16 and the bed is prevented from moving in any direction.

The bed 10 is provided with a collapsible and stowable guard rail assembly indicated generally at 38, one such assembly being located on either side of the elevating frame 14 and being illustrated in the upright or raised position on the right hand side of the bed as shown in FIG. 1 and 2 and in the lower position on the left hand side of the bed as shown in FIG. 2. The guard rail assembly will be described in more detail in FIGS. 18-22 but, in general, it includes a lower tubular base rail 40, an upper, parallel tubular rail 42 and a plurality of upright members 44 interconnecting the base rail 40 and the upper rail 42. A diagonal link 46 (FIG. 1) when latched into position maintains the guard rail in the upright, FIG. 1 position but, when unlatched, allows the upper rail 42 to pivot downwardly and to the right in FIG. 1 to overlie the base rail 40. Base rail 40 is connected at either end to a support plate 41 and, with the guard rail in the collapsed position the support plates can be released to pivot to the position shown on the right hand side of FIG. 2 so that the collapsed rail is swung downwardly and inwardly of the side edge of the elevating frame 14.

Figure 4:
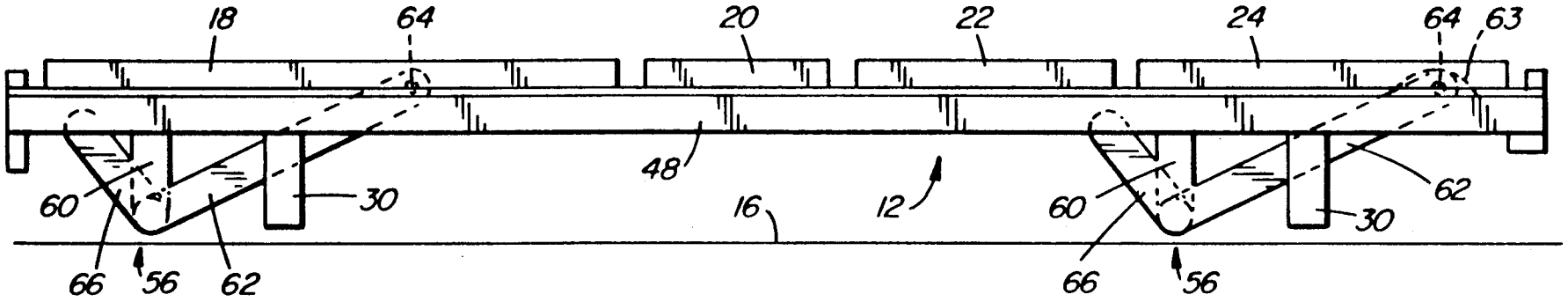
FIGS. 4, 5 and 6 are elevation and end plan views similar to FIGS. 1, 2 and 3, of the bed structure, but with certain elements omitted from the FIGS. 1-3 structure for the purposes of clarification.
Figure 5:
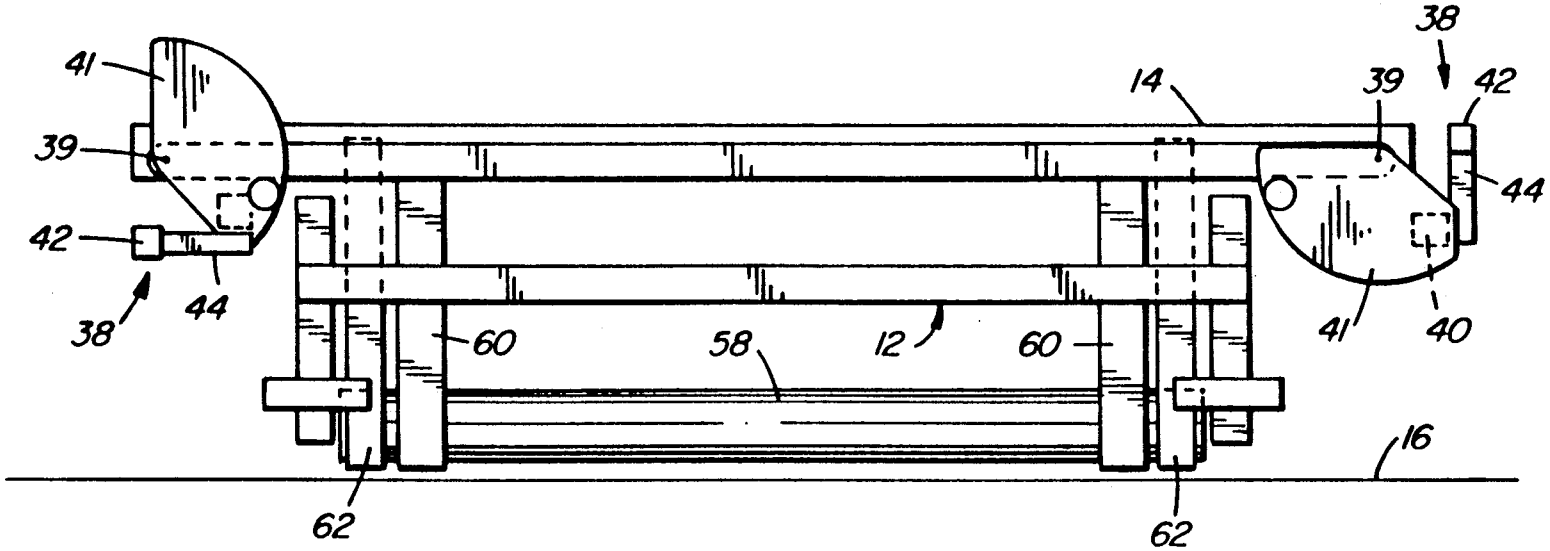
Figure 6:
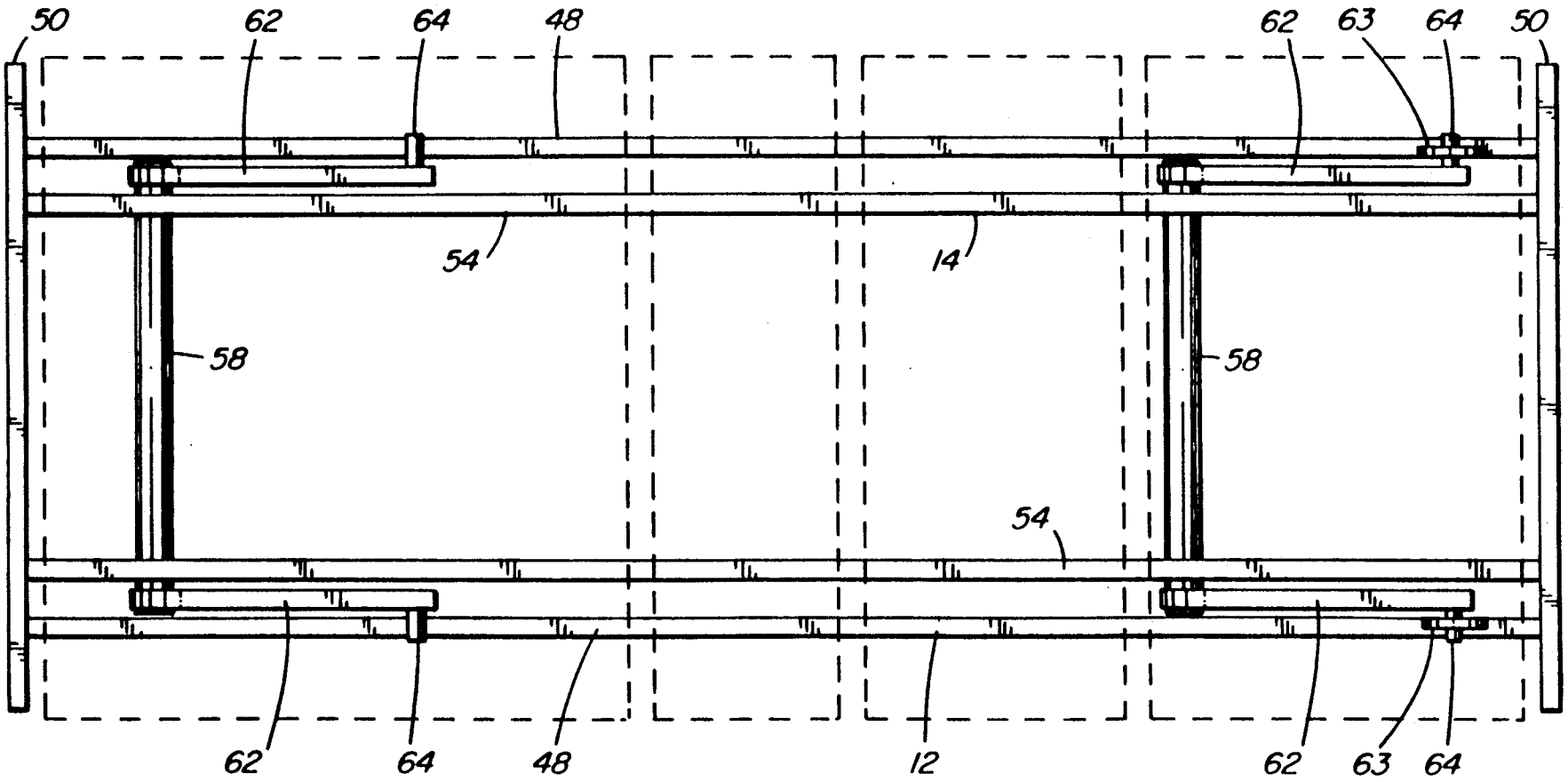

FIGS. 4, 5 and 6 give a somewhat less cluttered view of the stationary frame 12 and the elevating frame 14. Frame 12 has longitudinal side rails 48 connected by end rails 50 as well as crossmembers 52 shown in FIG. 3.

Elevating Assembly

FIGS. 4 and 6 clearly illustrate the relationship between the stationary frame 12 and its side rails 48 which lie parallel with but outboard of the longitudinal side rails 54 of the elevating frame 14, the association between the two being carried out by a portion of the elevating assembly (FIGS. 7-10) and particularly the lifting arm units located at each end of the frame structure and indicated generally at 56, each unit comprising a torsion tube 58 extending transversely of the longitudinal axis of the bed and being positioned for pivotal movement in the lower ends of struts 60 depending from the elevating frame 14, as shown in FIG. 4.

Each end of tube 58 is provided with a lift arm 62, so that there are two pairs of arms, one pair adjacent the head end and one pair adjacent the foot end as shown in FIGS. 4 and 6. The upper or outer end of each arm at the head end of the structure has an outwardly directed stud 64 to receive a bearing or roller (not shown) which, as can be surmised from FIG. 6, rests on the upper surface of the frame rails 48 of the stationary frame 12. At the foot end, the studs 64 on the upper ends of the arms 62 are rotatably mounted in bearing plates 63 secured such as by welding to the upper surface of the frame members 48 as illustrated in FIGS. 6 and 12.

Figure 7:
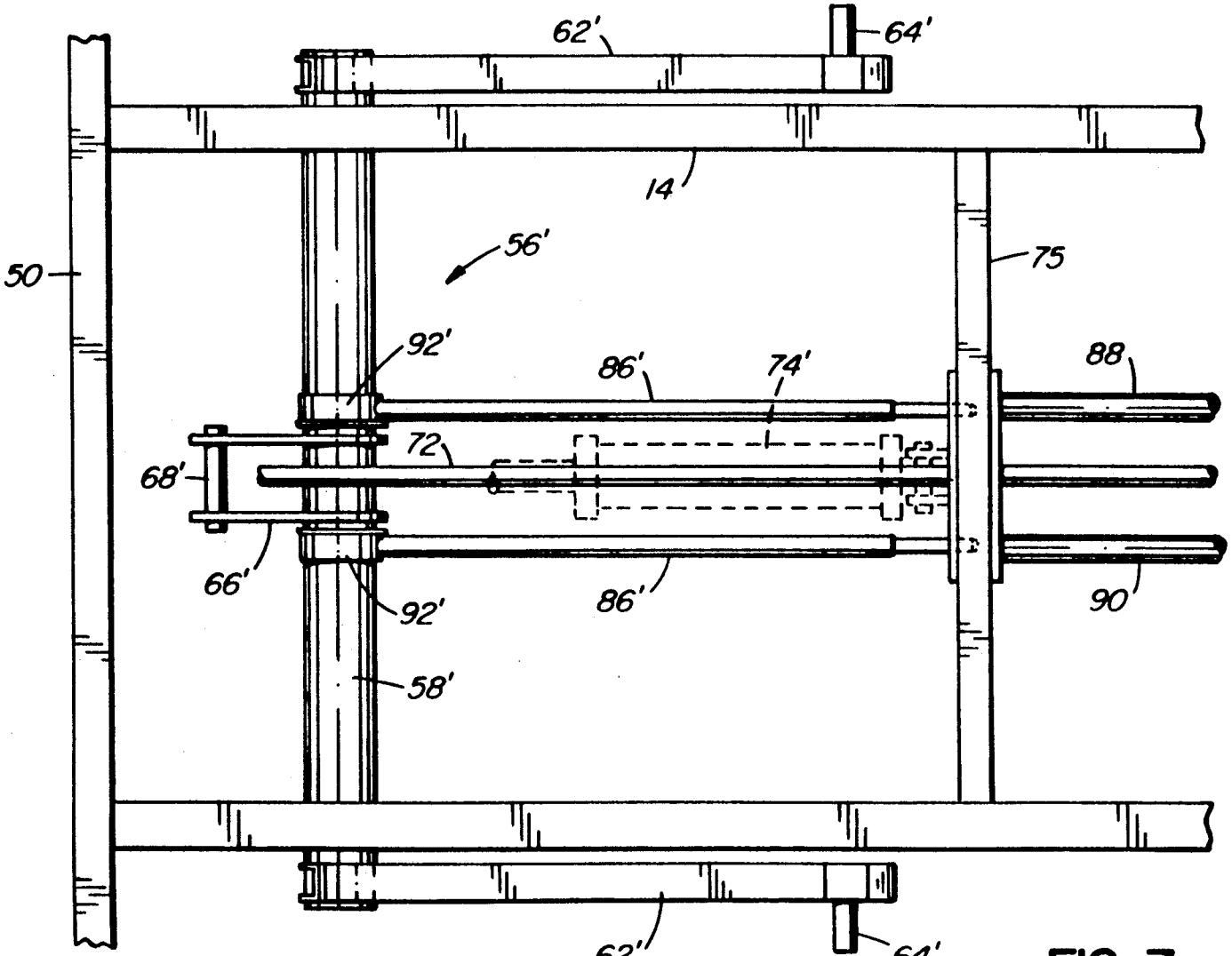
FIG. 7 is a plan view of part of the elevating means at the head end of the bed structure.
Figure 8:
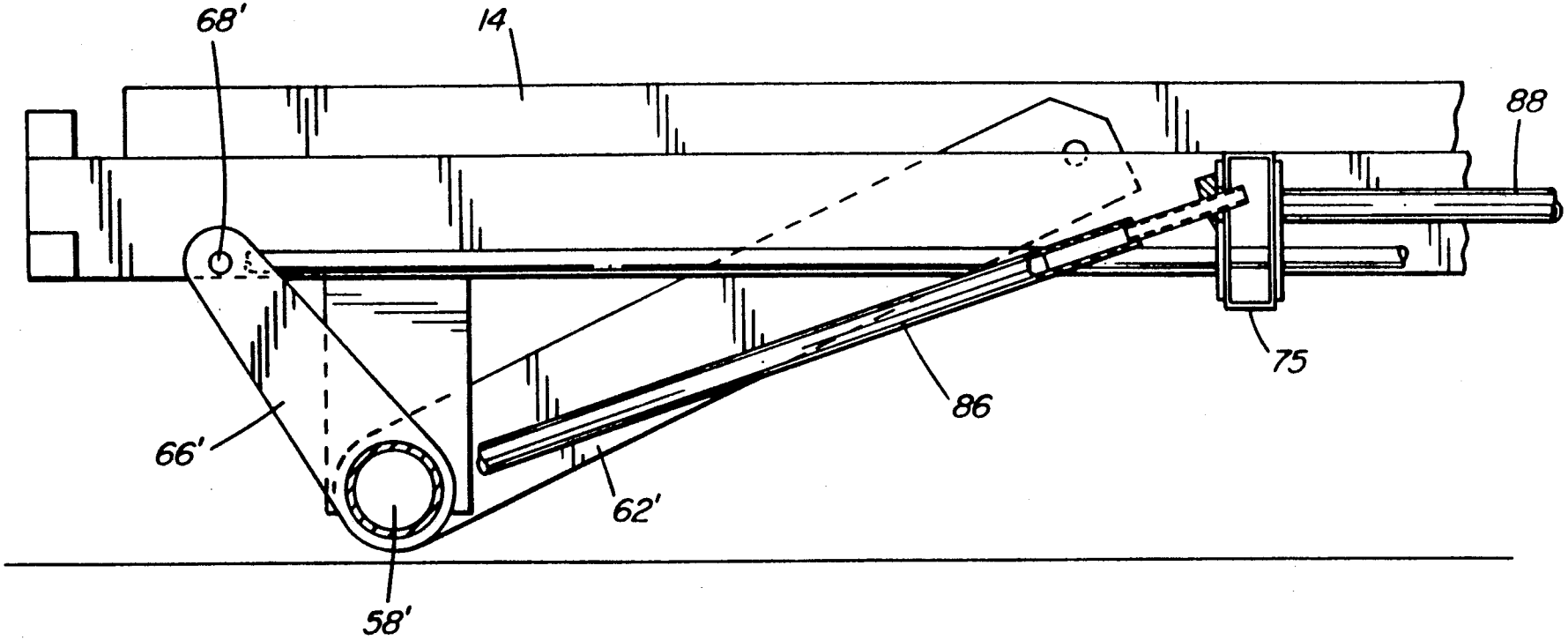
FIG. 8 is an elevation view of the subject matter of FIG. 7.
Figure 9:
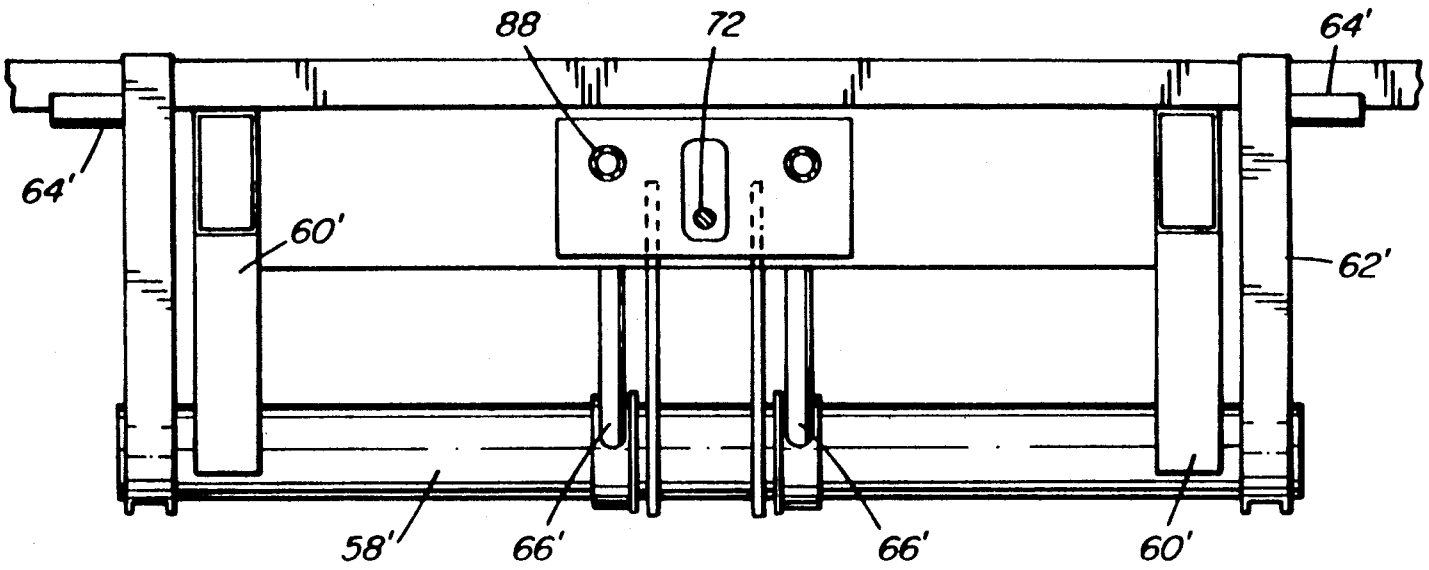
FIG. 9 is an end view of the elevating means at the head end of the bed structure.
Figure 10:
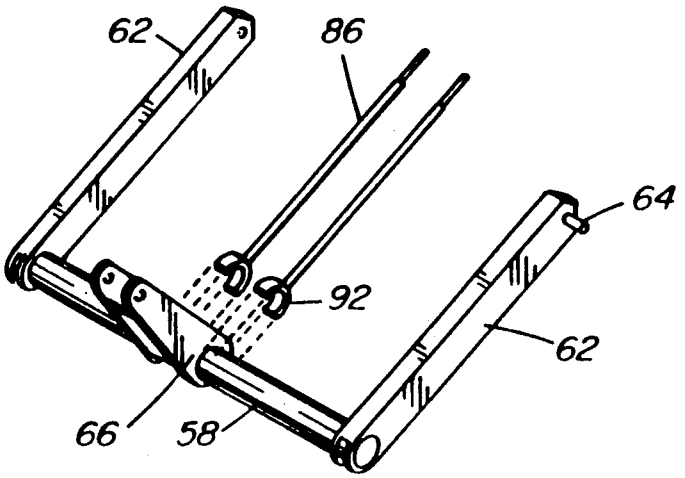
FIG. 10 is a perspective view of part of the elevating means.

Tube 58 is also provided adjacent its center portion with a pair of torque arms 66 which, as will be described later with respect to FIGS. 7-10, are engaged by an actuating cylinder which causes the torque arm 66 and side arms 62 to rise about the pivot point of the pins 64 thereby elevating the tube 58 which carries with it the elevating frame 14 through the torsion tube struts 60 so that the frame 14 reaches the phantom line position of FIG. 1. The frame elevating means is shown in FIGS. 7 through 12 inclusive. FIGS. 7, 8 and 9 illustrate the mechanism at the head end of the bed structure and FIGS. 12 and 13 illustrate the mechanism at the foot end.

As described earlier, the lift arm units 56 are located in the torsion tube struts 60 by means of the torsion tubes 58. Members of the lift arm unit at the head end of the bed will be referred to in prime numbers. Thus, torsion tube 58, is located in tube struts 60' and has a pair of lift arms 62' with the bearing pins 64, at the upper ends thereof. A pair of spaced torque arms 66' are secured to and extend upwardly from the central area of the torsion tube 58', the upper ends of the torque arms 66' being provided with a transverse connector pin 68' as shown in FIG. 7.

Figure 11:
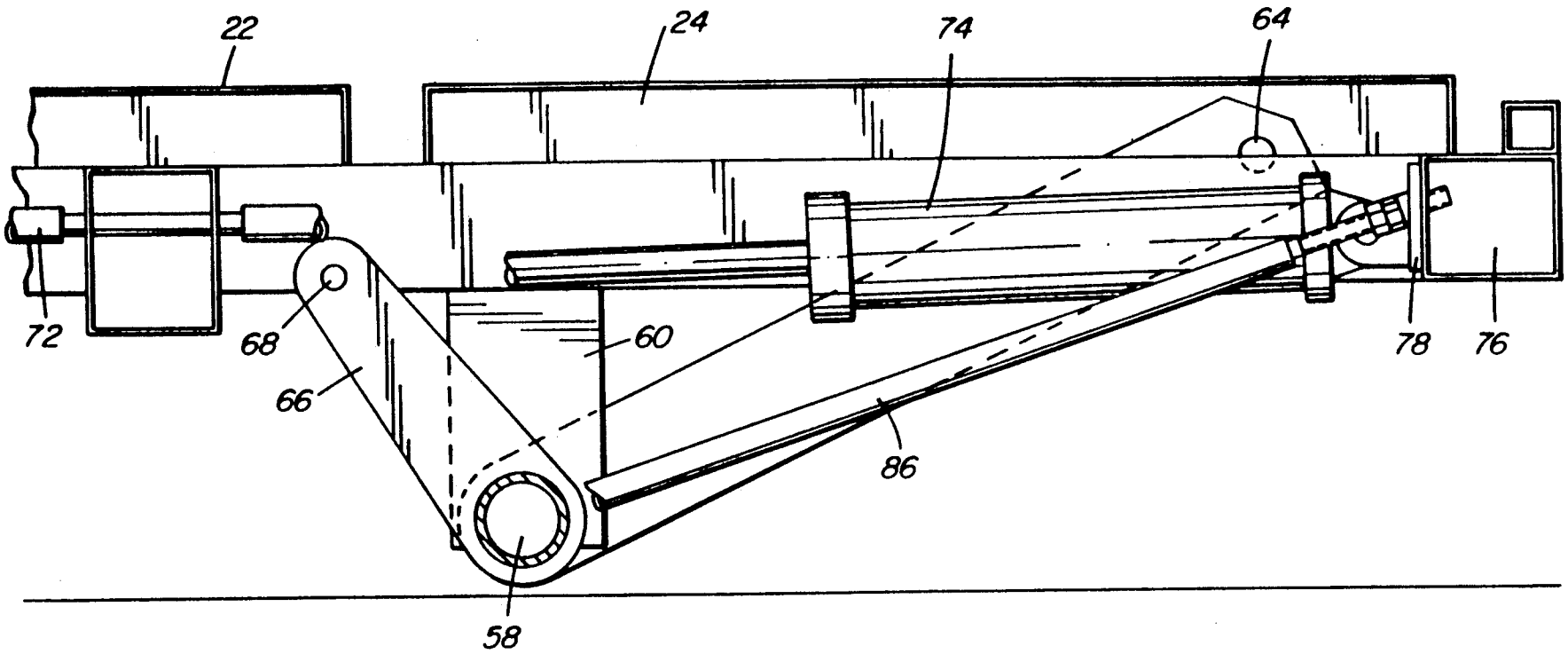
FIG. 11 is a side view, partly in section, of the elevating means at the foot end of the bed structure.
Figure 12:
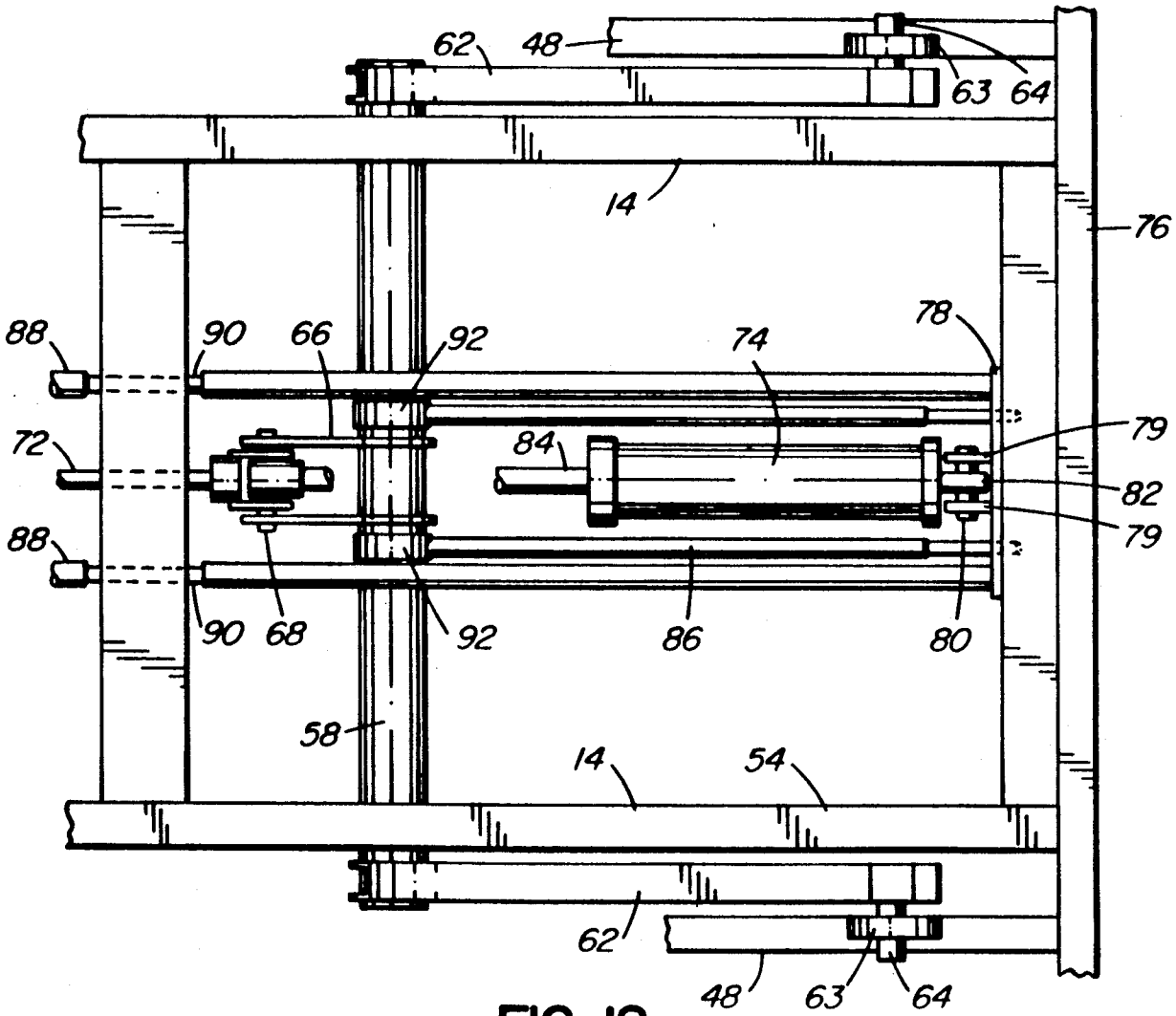
FIG. 12 is a plan view of the subject matter of FIG. 11.

At the foot end of the structure, as shown in FIGS. 11 and 12, torque arms 66 on torque tubes 58 have a transverse pin 68 at the upper end thereof and pin 68 retains a clevis 70 which secures one end of a connecting rod 72 which extends centrally of the bed structure and extends through the frame crossmembers to terminate at the cross pin 68' at the upper ends of torque arms 66' on the lift arm unit 56' of the head end of the bed. Thus, any movement to the torque arms 66 at the foot end of the bed is transmitted to torque arms 66' at the head end of the bed whereby the lift arm units 56 and 56' act in unison. It will be appreciated that due to the fact that rod 72 extends through the frame crossmembers, the nesting or compaction of the frames are enhanced.

Figure 13:
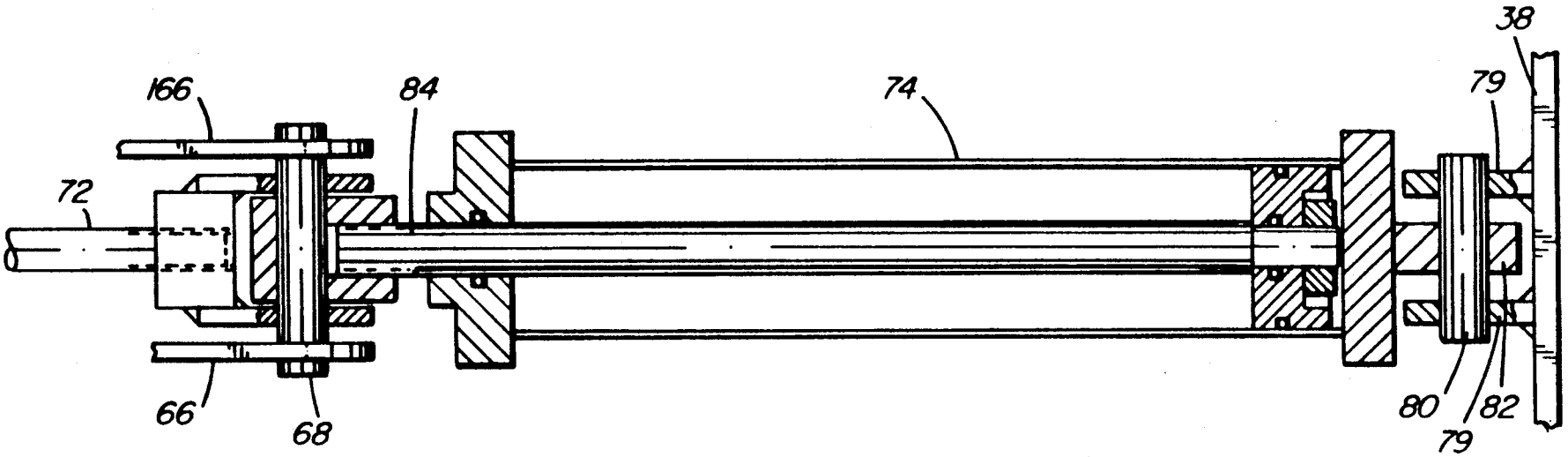
FIG. 13 is a sectional view of the actuator of the elevating means.
Figure 14:
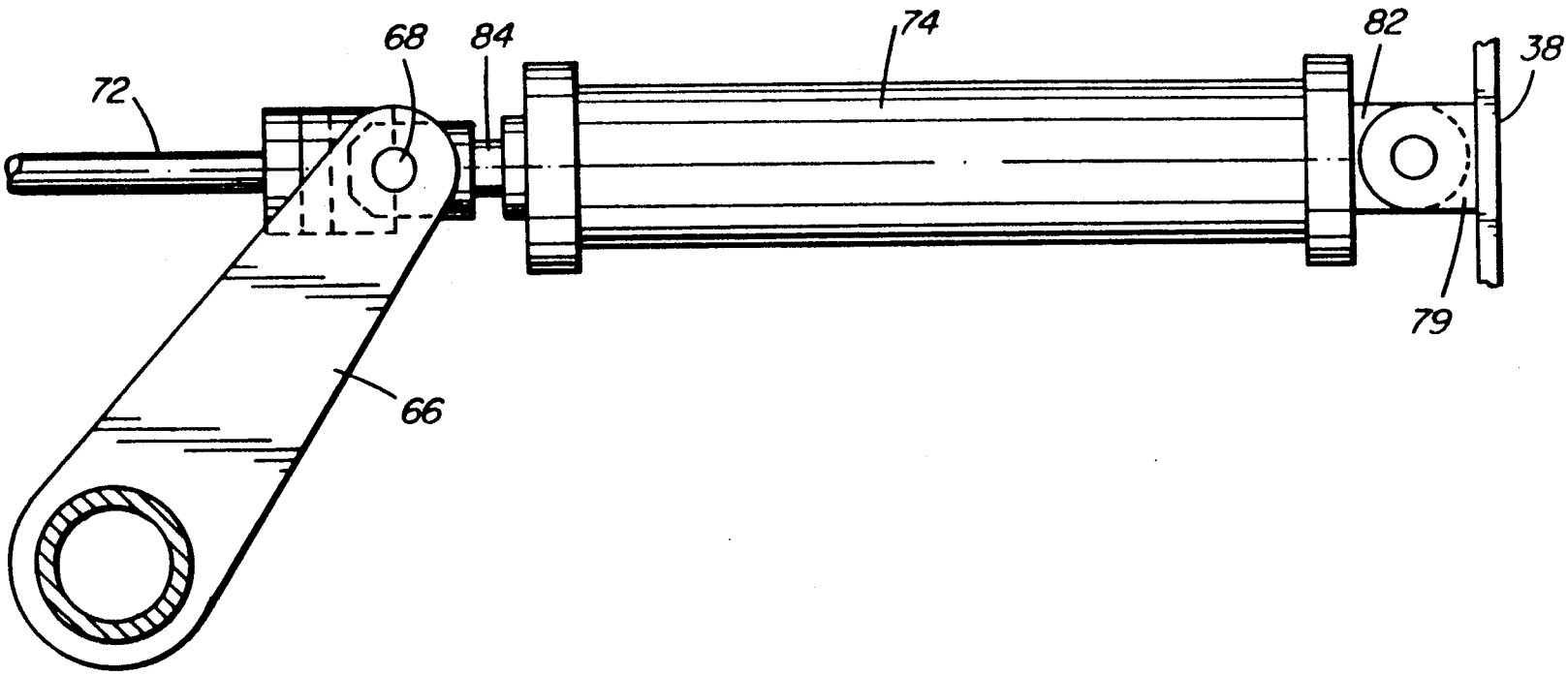
FIG. 14 is a side view of the subject matter of FIGS. 13.

The power necessary to rotate the lift arm units 56, 56' and therefore raise the frame 14, is provided by an actuator 74 located adjacent the foot end cf the bed as shown in FIGS. 12 and 13. The actuator is also illustrated in more detail in FIGS. 13 and 14. Referring for the moment to FIGS. 11 and 12, the actuator is connected to a cross member 76 of the elevating frame 14 and this connection is made by way of a stiffener plate 78 secured for example by welding to the cross member 76 and provided with a pair of spaced lugs 79 and pivot pin 80 which accepts a tongue 82 on the end of the actuator cylinder 74. The piston rod end 84 of the actuator is connected by pin 68 to the torque arms 66.

It will be appreciated that, depending on the direction of movement of the piston rod 84 of the actuator 74, the actuator will provide either a contracting or tensioning force between the frame cross member 76 and the two sets of torque arms 66 and 66, of the lift arm units 56 and 56'. When the actuator draws its piston inwardly from its position shown in FIGS. 11 and 12 in which the elevating frame is at its lowermost point shown in FIG. 1, the inward movement of the piston rod 84 causes the torque arms 66 and 66' to rotate about the mounting of the tubes 58 and 58' in the tube struts 60. Tubes 58 and 58', being rigidly secured to their associated torque arms 66 and 66', also applies a rotating or downward force to the arms 62 and 62' so that the bearing pins 64 at the head end of the structure with their associated bearings (not shown) are free to roll or glide along the frame rail 48 while pins 64 at the foot end are rotated within the bearing plates 63. This causes the actuator 74, the torsion tubes 58, 58' and the frame 14 to rise. Both the foot end and head end of the bed rise in unison due to the provision of the connecting rod 72 extending between the two sets of torque arms 66, 66'.

Figure 7A:
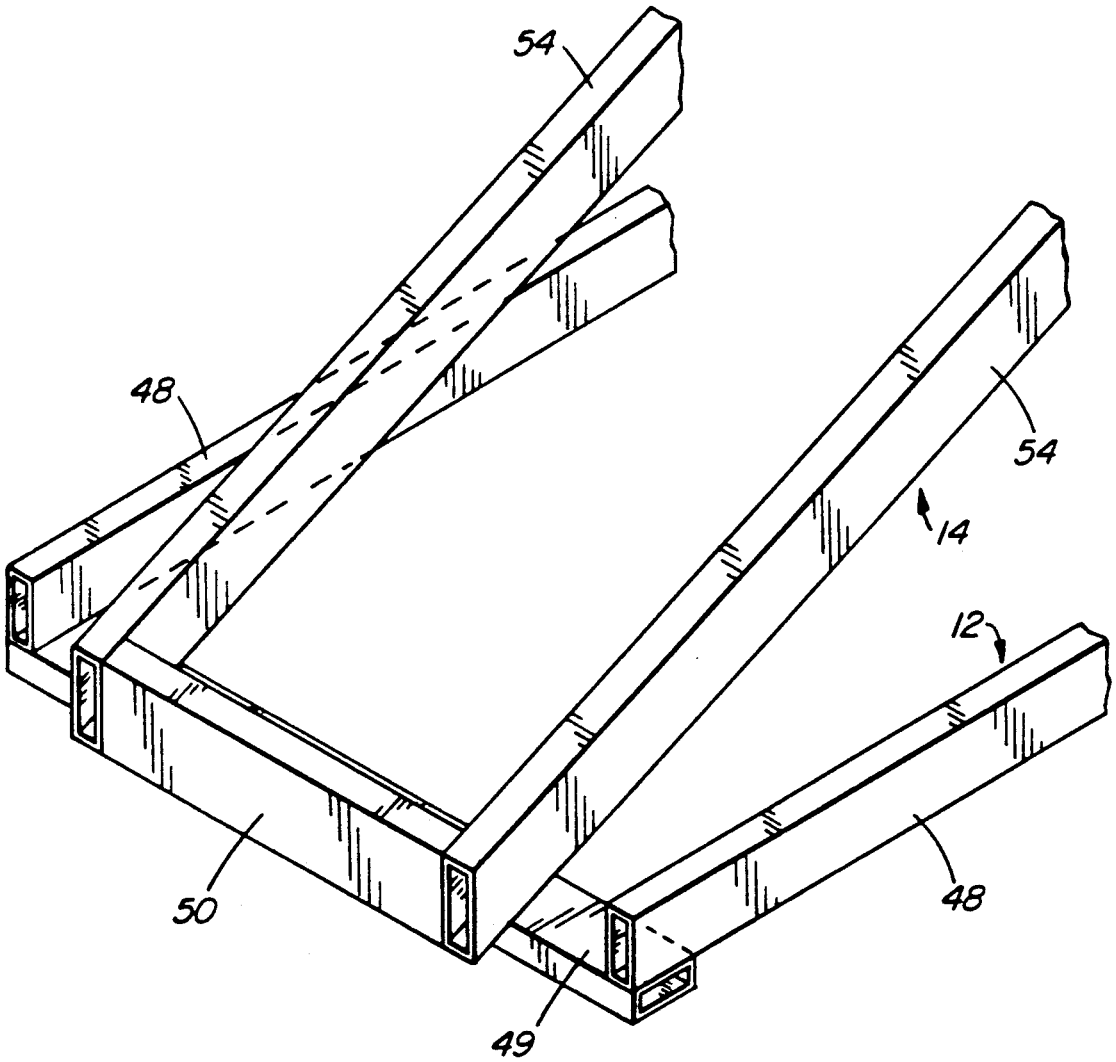
FIG. 7A is a fragmentary perspective view showing a tilting feature of the frame members.

An optional feature of the present invention is a means for allowing the connecting rod 72 to alternately provide a fixed or a non-fixed length between the pivot pins 68 and 68' in FIGS. 12 and 7 respectively. When the rod 72 provides a fixed length, as illustrated, the lift would operate evenly as described above. However, in an alternate arrangement, the rod 72 would become disconnected, in effect, to cause the actuator 74 to lift only the foot end of the bed while leaving the head end down as shown in FIG. 7*a*. This tilt is referred to as the trendelenberg position and is useful and required in certain patient care situations.

Two actuators can be used for the elevating mechanism if it is desired to tilt the bed in both trendelenberg and reverse trendelenberg positions. One actuator would be in the same location as in the illustrated single actuator version, i.e. actuator 74, FIGS. 11 and 12 but the connecting rod 72 would not be used. A second actuator 74' would be located as shown in phantom line in FIG. 7. The piston end of the second actuator would be connected to pin 68' and the cylinder end would be connected to crossmember 75. Each actuator could then be operated independently of or in unison with the other.

When tilting the bed, the elevating frame 14 rests on the crossmember 49 of the stationary frame 12 and slides on it. This action may occur on both head end or foot end and enables the bed to tilt even when at a low height.

A further feature of the invention is the use of compression rods 86, 86' in FIGS. 12 and 7 respectively and 88, 90 and 92. The lift mechanism will work as previously described without the above mentioned compression members or rods. However, the compression members transfer the large forces of the actuator 74 from the elevating frame 14 to the compression members themselves. In this way the frame can be of smaller dimensions effecting a cost and weight saving. The proportion of the forces which transfer to the compression members depends on their stiffness relative to the elevating frame.

As illustrated in FIGS. 7, 8, 11 and 12, compression rods 86 are connected at their upper ends to the stiffener plates 78, 78' and at their lower ends have semicircular journals 92 of the self lubricating type which engage the surface of their associated torque tubes 58, 58'.

Immobilizer Legs

Figure 15:
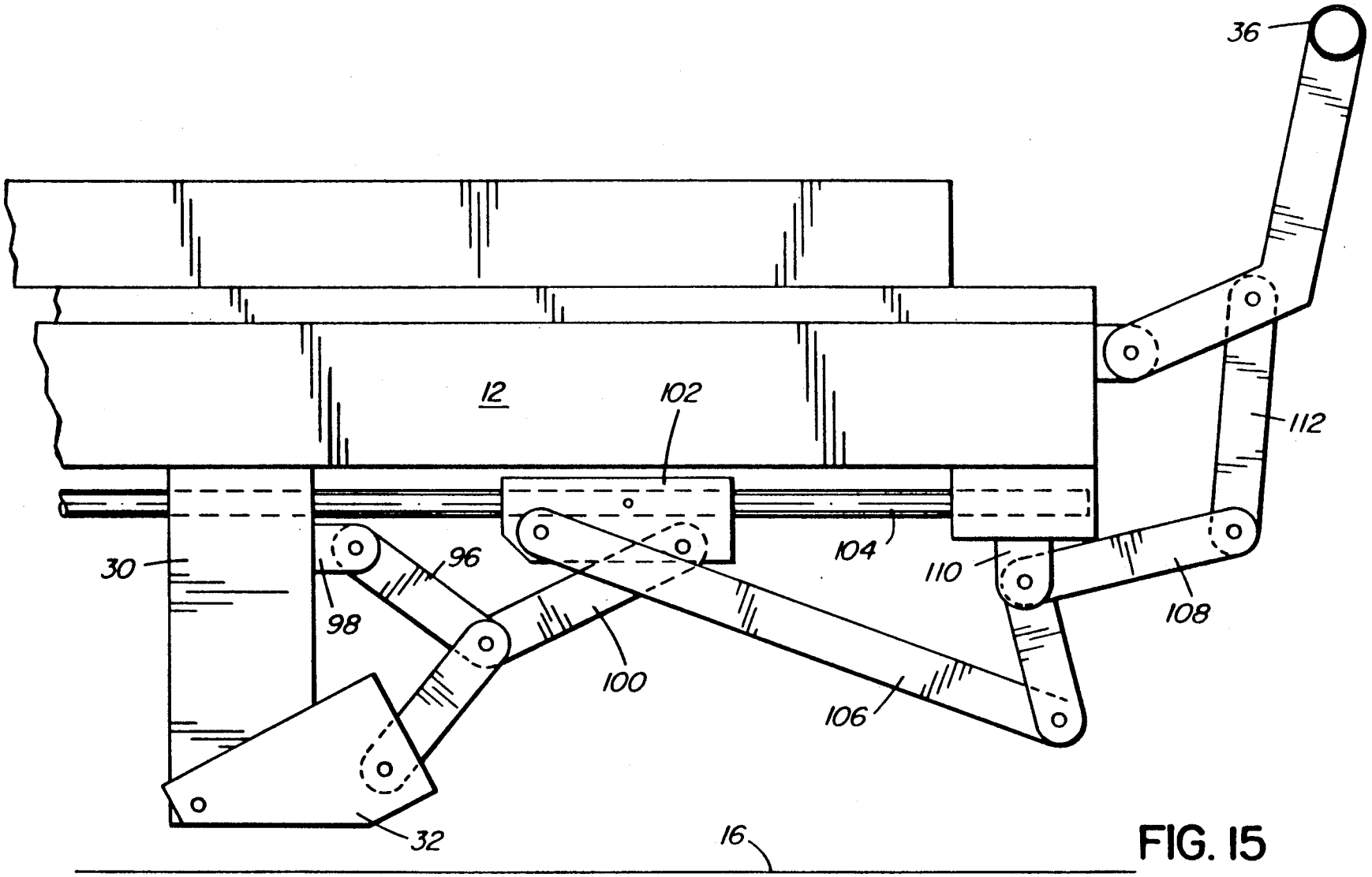
FIG. 15 is a side view of the immobilizer leg with the assembly thereof in a raised or inoperative position.
Figure 16:
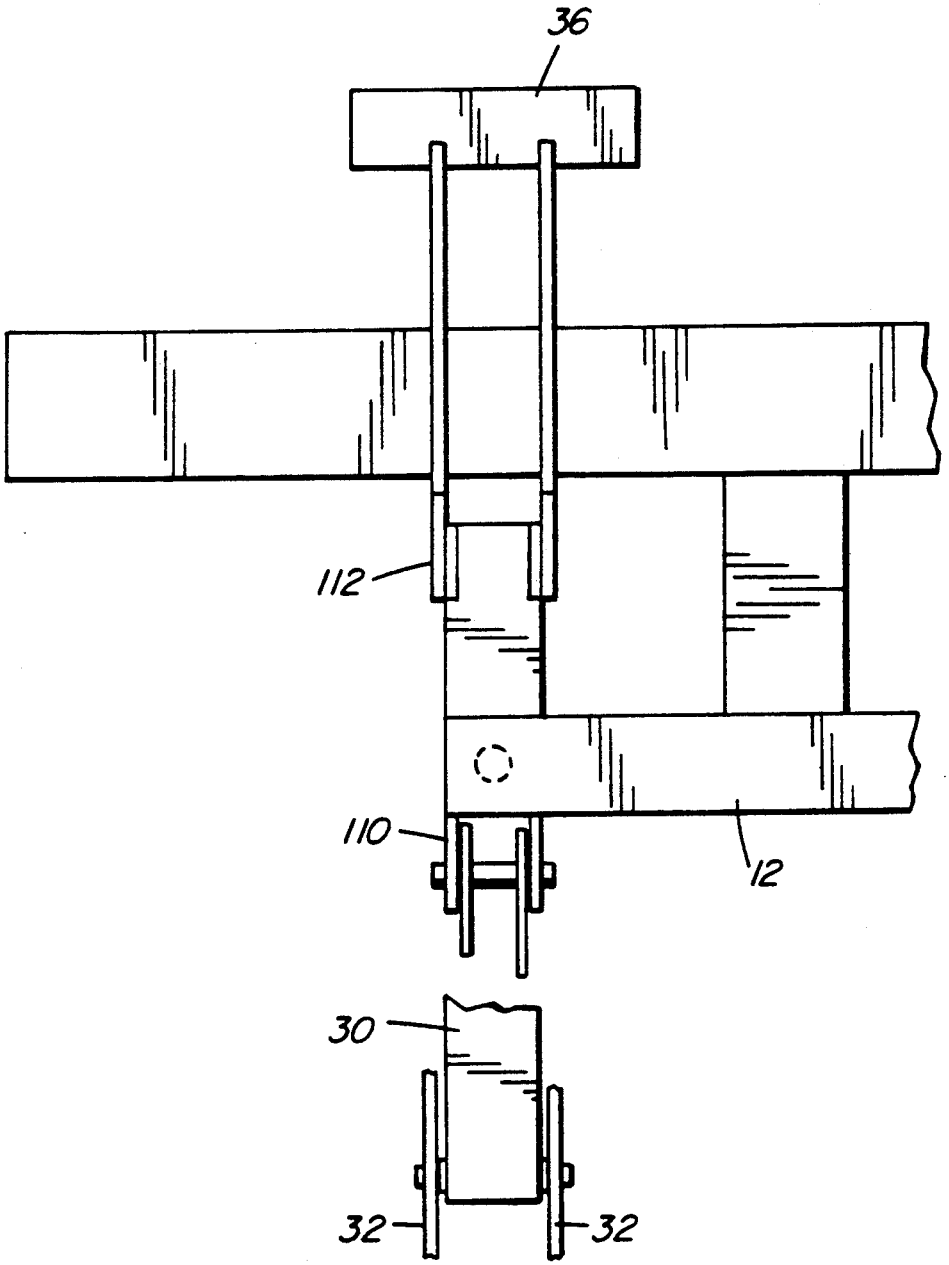
FIG. 16 a partial end view of the subject matter of FIG. 15.
Figure 17:
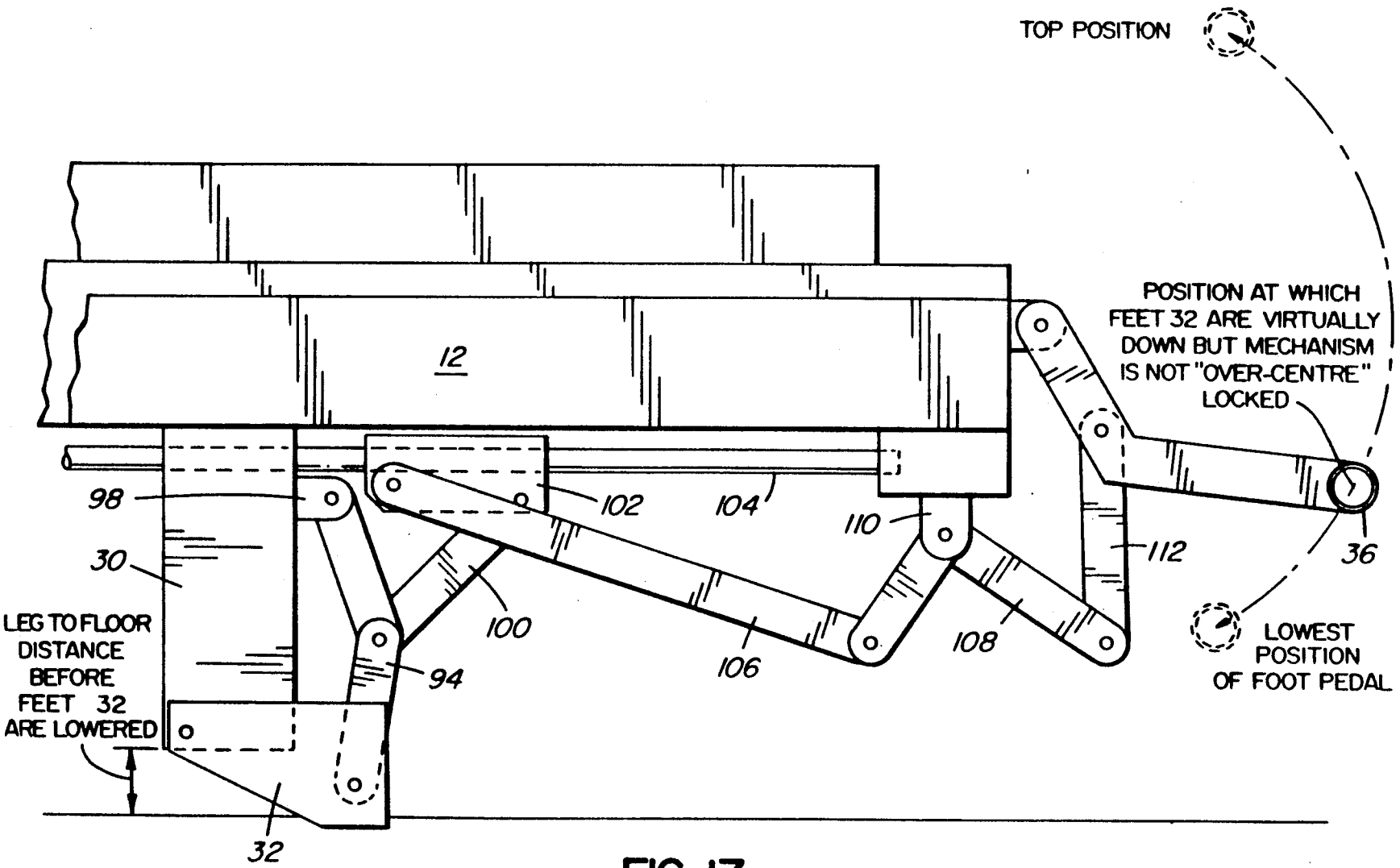
FIG. 17 is a view similar to FIG. 15 but showing the immobilizer in floor engaging position.

The means for immobilizing the bed is shown in FIGS. 15, 16 and 17. The operation of the immobilizing means has been briefly discussed with reference to FIG. 1. To reiterate, and referring to FIGS. 15 and 16, immobilizer legs 30 extend downwardly from the stationary frame 12 and the lower end of leg 30 falls short of the supporting surface or floor 16. Each leg is provided with a foot 32 pivotally secured at one of its ends to the leg 30. The other end of foot 32 is pivotally secured to one end of link 94, the other end of which is pivotally secured to two other links; 96, which is pivotally secured to the upper end of leg 30 by means of a lug 98, and link 100 which is connected pivotally to a slider 102 pinned on actuator rod 104. Slider 102 is interconnected to the immobilizer actuating pedal 36 through a series of several pivotally interconnecting members comprising a long link 106 connected at one end to the slider and at the other of its ends to a bellcrank 108 pivotally mounted on a lug 110 secured to the frame 12. The other end of bellcrank 108 is connected to the pedal 36 through a link 112.

FIG. 15 shows the immobilizer legs and feet 32 in an operative position allowing full weight of the bed to rest on the castor wheels 26 so that the bed can be freely maneuvered. When it is desired to immobilize the bed, the crank 36 is moved downwardly from its top position shown in full line in FIG. 15 and in phantom line in FIG. 17 to an intermediate point shown in full line in FIG. 17 where the feet 32 are virtually down but the mechanism comprising the interconnected linkages are not yet over-center or locked. In this position, the legs contact the floor as pedal 36 is pushed down and the links 112, 108 and 106 push the slider 102 horizontally taking with it the rod 104 to which it is connected. This actuates the leg 30 at the other end of the bed but on the same side thereof so that each pedal 36 operates two legs simultaneously. From the position shown in FIG. 17, the pedal is then pressed downwardly to its lowest position as indicated and this will move the two links 112 and 36 over-center to lock the foot 32 in its illustrated position, raising the leg castors and the bed upwardly, so that the castors are about one eighth of an inch above the floor level. Reversing the position of the pedals 36 to their uppermost positions will raise the feet 32 and will lower the bed onto its castors 26.

Guard Rail

The guard rail structure 38 has been described briefly in reference to FIGS. 1, 2 and 5 of the drawings. Reference should now be made to the more detailed discussion of this structure as shown in FIGS. 18 through 24.

Figure 18:
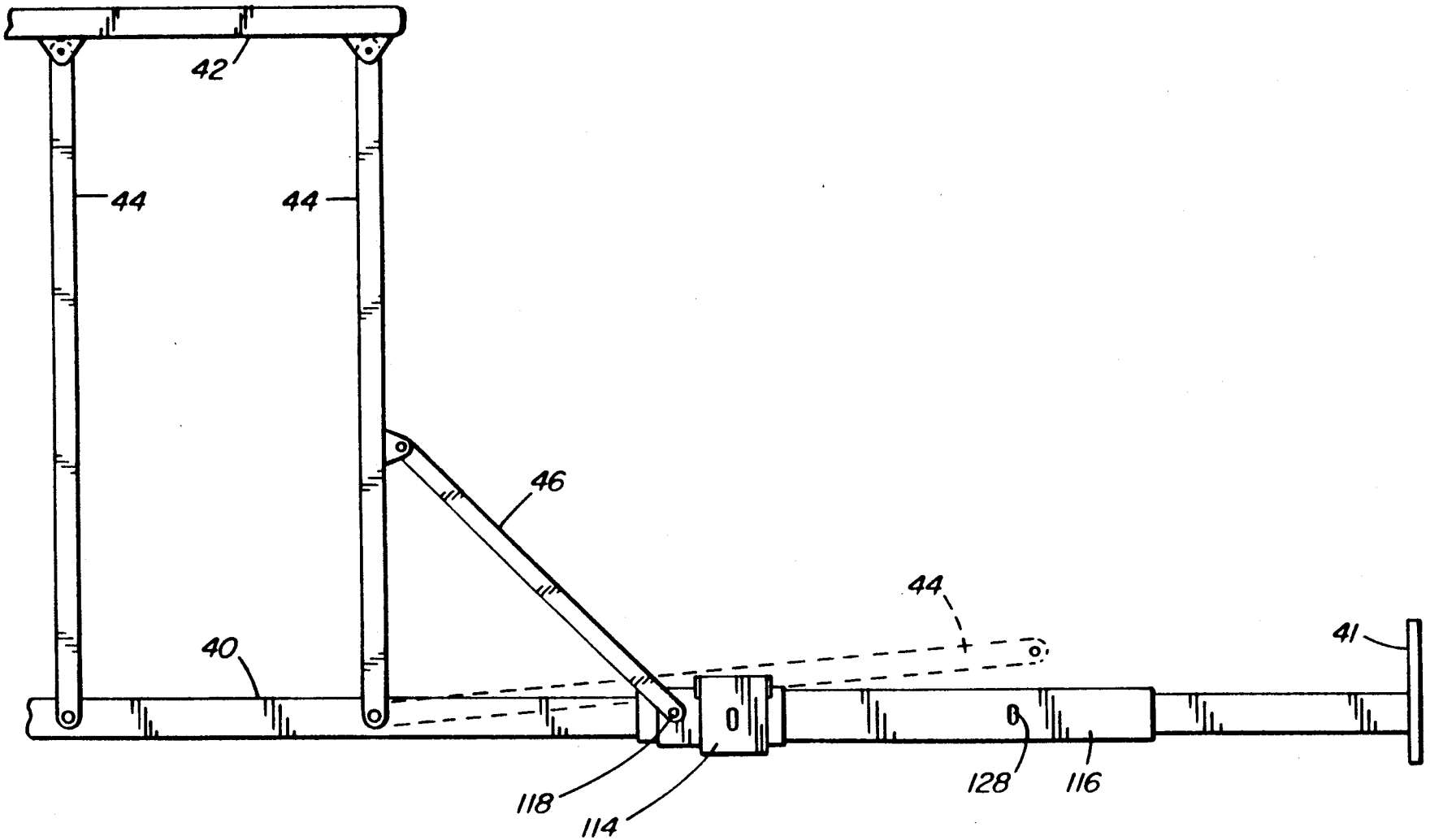
FIG. 18 is a side view of a portion of the guard rail showing the uprights and upper rail in a raised or operative position.
Figure 20:
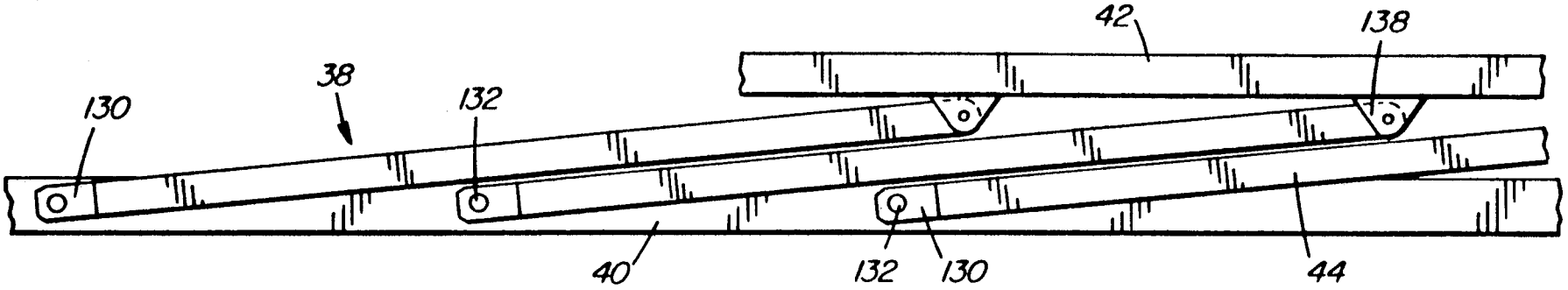
FIG. 20 is an elevation view of the upper guard rail and uprights in a collapsed position.

The guard rail structure 38 can pivot from its upright position shown in FIG. 18 to a collapsed position shown in FIG. 20 so as to allow normal access to the mattress surface of the upper, elevating bed structure. If necessary, the collapsed structure 38 as shown in FIG. 20 can be rotated to a position completely out of the way of the side edge of the bed structure 14 to a storing position below that edge. The end view of the bed structure in FIG. 5 shows, on the right hand side, the guard rail 38 in a collapsed position similar to FIG. 20 where the upright members 44 and the upper rail 42 are rotated to their lowermost point so that the rail 42 is more or less coplanar with the upper surface of the frame structure 14. See also FIG. 24. In this position, the guard rail support plate 41 which is pivotally mounted about pivot point 39, is in its operative position although the uprights and top rail have been collapsed.

The left hand side of FIG. 5 shows that support plate 41 together with the guard rail assembly 38 secured thereto, has been pivoted about its point 39 so that the guard rail assembly 38 is relocated from a point to one side of the frame 14 to a point that is underneath the mattress support surface and completely clear of the side. This will greatly facilitate certain nursing situations such as the transfer of a patient from one bed to another, where complete clearance along the side of the bed is necessary.

The means for collapsing the guard rail structure 38 and for relocating and locking the assembly 38 in its operative and inoperative or stored positions, are shown in FIGS. 18 through 24.

Figure 19B:
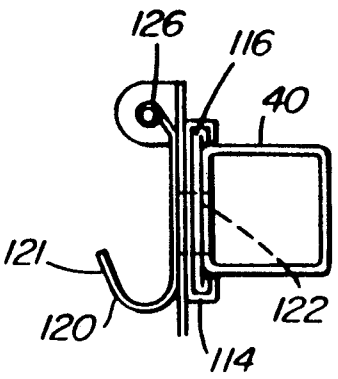
FIGS. 19A and 19B are left end and right end views respectively of the subject matter of FIG. 19.
Figure 19:
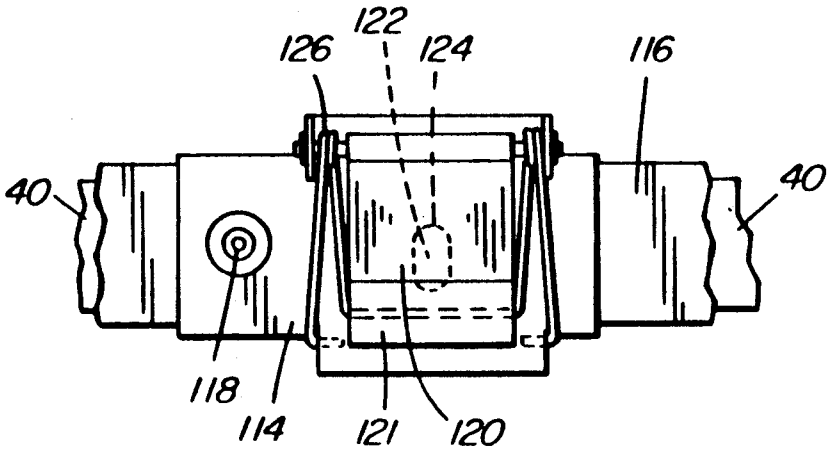
FIG. 19 is an elevation view the guard rail latch means.
Figure 19A:
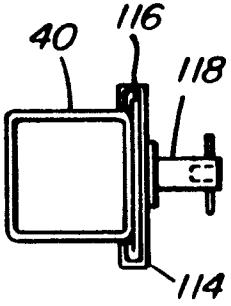

Looking firstly at FIGS. 18 and 19, the diagonal guard rail link 46 is connected at its upper end to the end upright 44 and, at its other end, to a movable slider 114. This slider is mounted for reciprocal movement on a track 116 secured to the base rail 40 of the assembly 38, FIG. 1. As shown in FIG. 19A, the slider 114 is provided with a stud 118 to pivotally mount the lower end of the diagonal link 46. The slider is provided with a latch 120 having an upturned portion as shown in FIG. 19B which can be grasped by an operator's fingers. Latch 120 has pin 122 on its rear surface which engages a slot 124 in the slider and base rail 40. The latch 120 is biased to its FIG. 19B position by a spring 126 and, when a nurse or attendant wants to lower the assembly 38 the latch 120 is pulled outwardly to remove the pin 122 from the aperture 124 and the slider 114 is then moved down to the right (as seen in FIG. 18) and the pin 122 engages another aperture 128 in the track to lock the assembly 38 in its collapsed position of FIG. 20.

Figure 21:
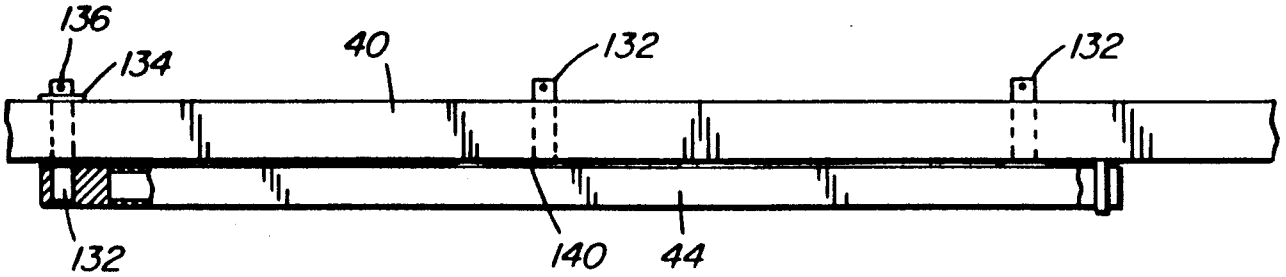
FIG. 21 is a plan view of part of FIG. 20; .
Figure 22:
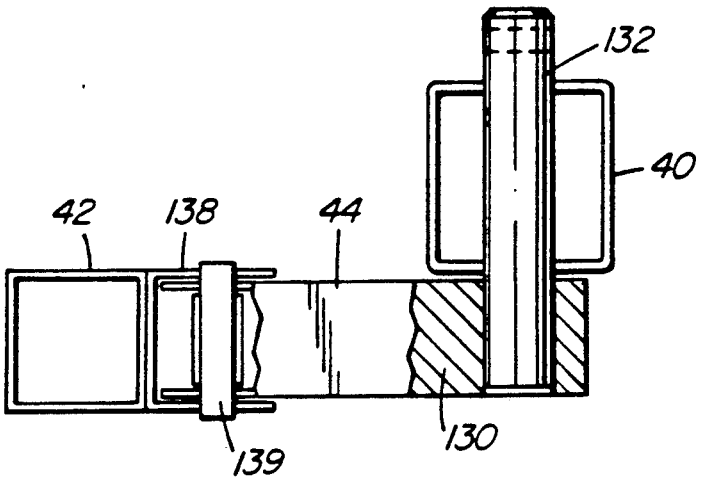
FIG. 22 is a segmental view, partly in section, of a portion of the guard rail structure.

FIGS. 21 and 22 provide details of the mounting of the uprights 44 to the base guard rail 40. Each upright 44 has a solid metal end 130 thereon and a pivot pin 132 is welded to the block 130 and projects inwardly to pass through an aperture provided for each pin 132 in the outer sides of the lower rail 40 as shown in FIG. 22. The pin is retained in the lower rail 40 by means of suitable washers 134 and pins 136. The upper end of the members 44 are pivotally attached to the top rail 42 by means of flanges 138 depending from the rail 42 and pivot pins 139 pressed therethrough as shown in FIG. 22. Spacer means 140, FIG. 21, are located on the pins 132 between the lower end of the upright members 44 and the lower rail 40 to prevent any surface binding of the two members.

It will be appreciated that the above structure together with the fact that the rail members and uprights are made from rectangular tubing, provides a very accurate and tight assembly.

Figure 23:
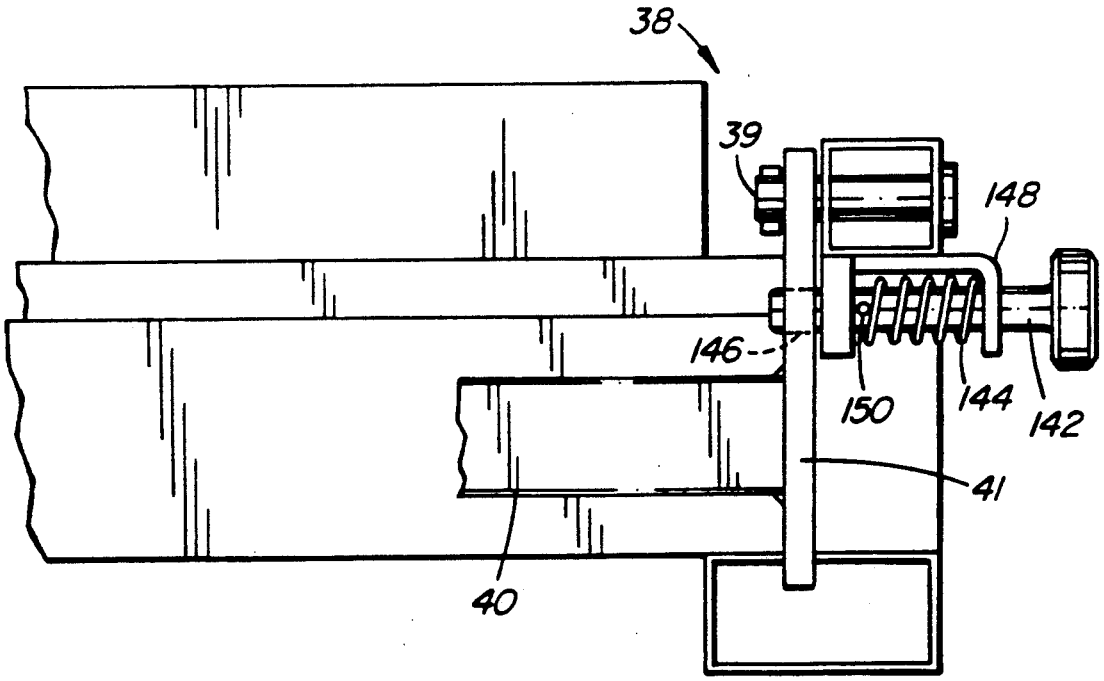
FIG. 23 is an elevation view of a portion of the end of the bed, frame, partly in section, of the guard rail latch rotation means.
Figure 24:
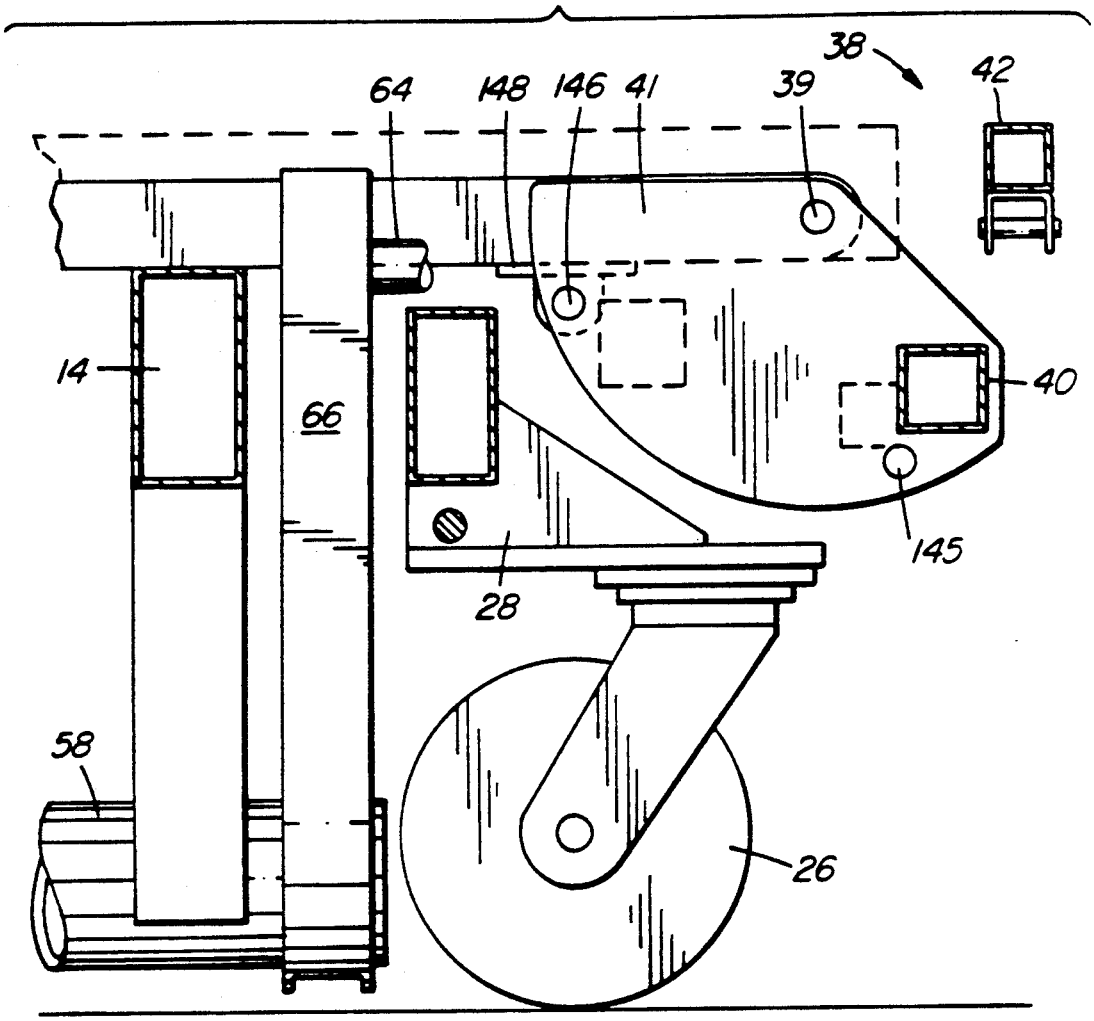
FIG. 24 is an end view, partly in section, looking towards the foot end of the bed from the central area thereof and showing the guard rail latch rotation means.

Turning now to FIGS. 23 and 24, the position of the guard rail end plate 41 and the guard rail assembly 38 is the same in FIGS. 23 and 24 as it is in the right hand side of FIG. 5. That is, the rail assembly 38 is collapsed to its FIG. 20 position but it still lies along side frame 14 with the top of the upper rail 42 being generally coplanar with the top of the mattress support surface.

The guard rail assembly base rail 40 and the end support plate 41 are locked in this position by means of a releasable latch in the form of a pin 142 which is biased by a spring 144 to a locking position shown in FIG. 23 where the pin 142 extends through an aperture 146 in the end plate 41 and which, in this position, is in alignment with the spring biased pin latch bracket 148. As shown in FIG. 23, pin 142 passes through both arms of the bracket 148 with the spring 144 bearing against one inside surface of the bracket and, at the other end, against a pin 150 to thereby bias the pin to its looking position shown in FIG. 23.

The end plate 41 is provided with a second aperture 145 as seen in FIG. 24 and in order to shift the assembly 38 from its positions of FIGS. 23 and 24 to the fully stored position of the left hand side of FIG. 5, it is necessary only for an attendant to pull the pin 142 outwardly i.e. to the right in FIG. 23 and rotate the assembly about the pivot pin 39, in a clock wise direction as shown in FIG. 24 so that the aperture 145 in the end plate is moved around so that it aligns with the pin 142 at which point the spring 144 will drive the pin home to a locking position in aperture 145 so that the rail assembly 38 is now in its stored position of the left hand side of FIG. 5. When the rail is needed again, it is a simple matter to reverse the procedure, pulling the pin 142, rotating the plate 41 and the rail assembly 38 to its FIGS. 23 and 24 position and then releasing the slider 114 and moving it towards the head end of the bed to shift the uprights and the upper rail to its fully upright and operative position shown in FIG. 1.

It is important to notice from FIGS. 5 and 24 that when the rail assembly is moved to its stored, out of the way position, it has an absolutely minimum effect on the clearance under the center part of the bed structure.

Gatch Mechanism

Figure 25:
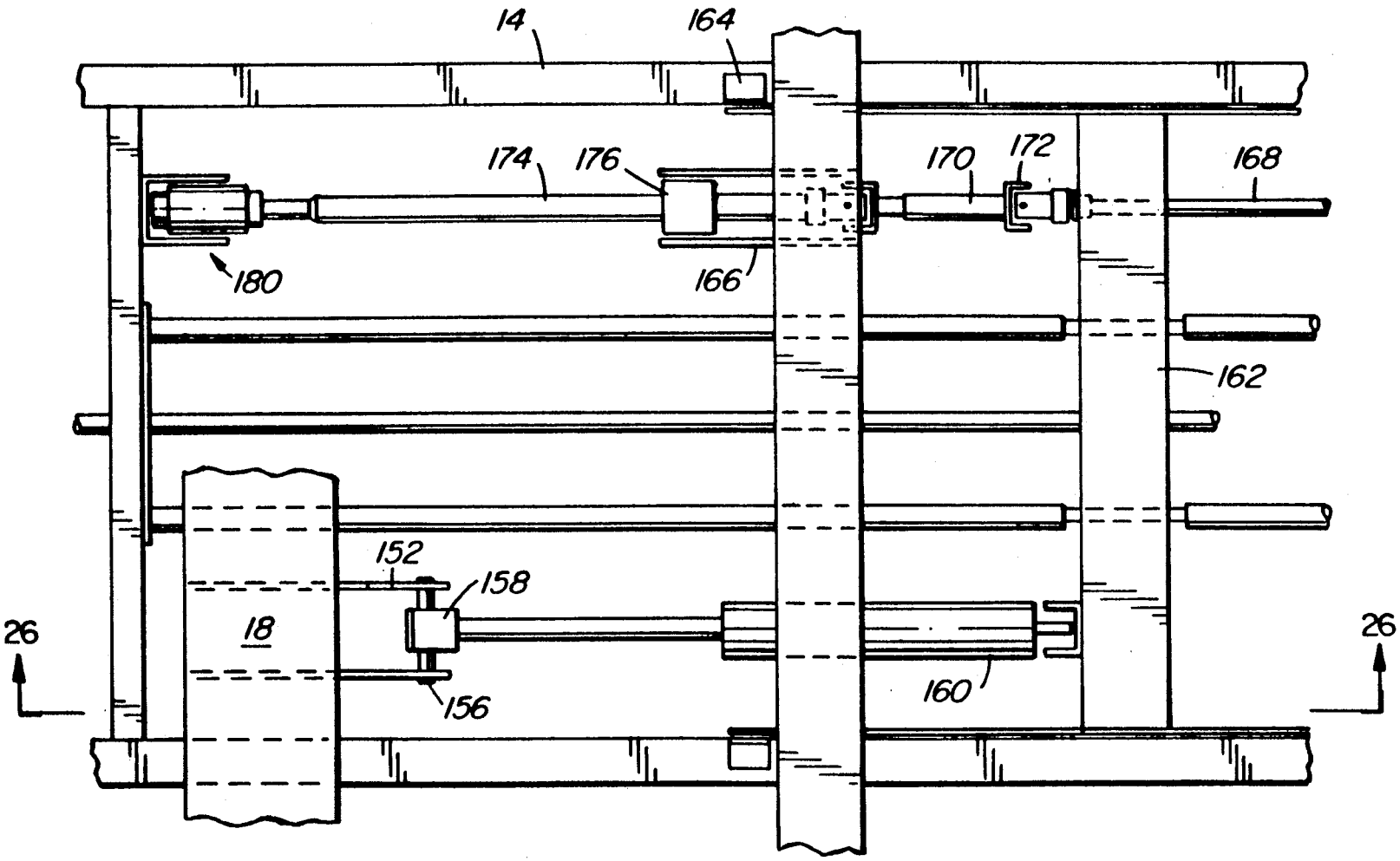
FIG. 25 is a plan view of the gatch actuating means.
Figure 26:
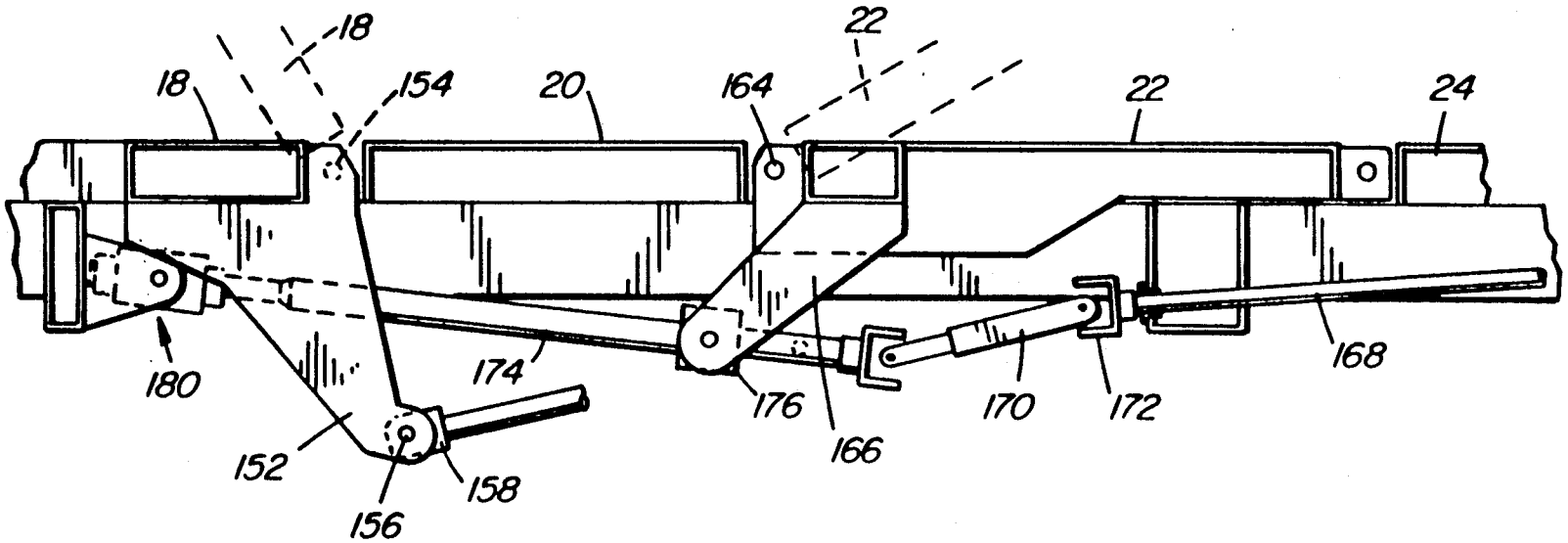
FIG. 26 is a cross sectional view as seen along the lines 26—26 of FIG. 25.

FIGS. 25 and 26 are plan and sectional views respectively of the mechanism for operating the head and knee gatches of the bed structure.

FIGS. 25 and 26 are plan and sectional views of the mechanism for actuating the gatch panels 18, 20, 22 and 24 illustrated in FIG. 1.

The foot end of the bed is to the right in FIGS. 25 and 26 and the head end is to the left.

The head gatch or panel 18 is hinged to the frame 14 by means of a pivotal connection 154 thereto and the panel or gatch 18 is moved about that pivot point 154 by means of a pair of arms 152. These arms extend downwardly to mount a pivot pin 156 which receives the piston rod end 158 of an actuator 160 pivotally secured at its cylinder end to a frame crossmember 162. It will be appreciated that extending the piston rod end 158 of the actuator to the left in FIG. 25 or FIG. 26 applies a force to the lower end of the arms 152 and pivots the gatch 18 about point 154 to its upright position shown in phantom line in FIG. 26. The knee gatch operates in a similar manner, the panel 22 being pivoted about hinge pin 164 by force applied to the depending arms 166 of gatch panel 22.

Any suitable mechanical, electrical or hydraulic means can be used to apply the necessary forces to the arms 152 or 166 but in the present illustration, a hand operated screw means is shown for operating the arms 166. This takes the form of a series of drive shafts 168 and 170 interconnected by a universal joint 172 and a further shaft 174 threaded to receive a captive nut 176. The head end of the shaft 174 is positioned in a suitable bearing mount indicated generally at 180.

It will be appreciated that hand cranking or otherwise rotating the drive shafts 168, 170 and the screw surface shaft 174 will cause the captive nut 176 on the shaft 174 to be moved to the left or to the right on 174 to thereby pivot the arms 166 and its associated gatch panel about the pivot hinge pin 164.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A variable height bed for use in hospitals and like facilities; said bed comprising:

a) a stationary frame having a castor foot adjacent each corner thereof;

b) an elevating frame interconnected with said stationary frame and moveable in elevation with respect to said stationary frame;

c) frame elevating means for effecting vertical and tilting movement of said elevating frame relative to said stationary frame at any elevation and including linking means operable by said frame elevating means and interconnecting said stationary frame and said elevating frame, said elevating means providing movement of said elevating frame from a lowermost elevation position of approximately ten inches above a supporting surface to an uppermost elevation position of approximately twenty nine inches above said supporting surface;

d) means operable at any elevation of said elevating frame for immobilizing said bed against movement on said supporting surface;

e) head and knee gatch members detachably secured to the upper surface of said elevating frame and means for actuating said head and knee gatch members to angularly elevated or flat positions with respect to said upper surface;

f) a guard rail assembly secured along each side of said elevating frame, each guard rail assembly comprising a lower rail secured to said elevating frame and an upper rail spaced therefrom and parallel thereto, with a plurality of upright members interconnecting said upper and lower rails;

g) means for diagonally collapsing said upper rail and upright members down onto said lower rail member; and means for pivoting said collapsed guard rail assembly from a position adjacent the side edge of said elevating frame to a position beneath said side edge;

h) wherein said stationary frame and said elevating frame each have longitudinal, parallel side rails and end rails; the side rails of said elevating frame being spaced inwardly of the side rails of the stationary frame; and a pair of strut members extending downwardly from said elevating frame adjacent each end thereof; said frame elevating means comprising at least one pair of lifting arm units, adjacent at least one end of said bed; said lifting unit comprising:

(i) a torsion tube extending transversely of the longitudinal axis of said bed and mounted for rotation in a pair of said strut members;

(ii) a pair of lift arms, one at each end of said torsion tube, said arms extending angularly upwardly and means at their upper ends for engaging the side rails of said stationary bed frame;

(iii) at least one torque arm mounted on said torsion tube and extending angularly upwardly therefrom; and (iv) actuating means mounted to said elevating frame at one of its ends and longitudinally extending rod means connecting its other end to said torque arm of said lifting units, whereby, operation of said actuating means in one direction causes said torsion tube and its associated torque arm and lifting arms to rotate in said strut members, raising at least one end of said elevating frame above said stationary frame; and operating said actuator in the opposite direction lowers said elevating frame;

(v) said connecting rod means extending centrally of said elevating frame and passing through the cross members thereof whereby nesting of said stationary and elevating frames are substantially enhanced.

2. A bed according to claim 1 including a pair of torque arms on each torsion tube adjacent the center thereof, said actuating means comprising a hydraulic cylinder, the piston rod end of which is connected to said torque arms.

3. A bed according to claim 1 wherein the means at the upper end of each said lift arm comprises an outwardly directed pin member; a roller mounted on said pin members on the arms at one end of the structure and resting on the rail of said stationary frame; and bearing plates on said rails of said stationary frame at the other end of said structure and receiving the pin members of the arms at said other end.

4. A bed according to claim 1 wherein said immobilizing means comprises a pair of stationary leg members on each side of said stationary frame and located inwardly of the ends thereof and spaced from adjacent castor means, said leg member falling short of the support surface;

a foot pivotally secured to each leg member of each pair thereof, a series of link members interconnecting each said foot with actuating lever means which, when operated, effects pivoting said foot downwardly into contact with the supporting surface to raise the bed and the castors above the supporting surface.

5. A bed according to claim 1 wherein each said guard rail assembly includes the upright members being pivotally mounted at their lower ends to the outside of said lower rail member and, at their upper ends, pivotally secured between flanges depending from said upper rail member; a diagonal strut interconnecting the end upright member with a moveable slider on said lower rail member, and means on said slider and said lower rail for detachably looking said slider in two positions on said lower rail, one said position looking the assembly in an upright, operative position and the other position to collapse the upper rail onto the lower rail in a "down" position.

6. A bed according to claim 5 including means for moving said collapsed assembly to a stored position under said elevating frame, comprising an end plate secured to each end of said lower rail, each end plate being pivotally mounted to an end rail of said elevating frame; each said end plates being rotatable about its pivotal connection to said elevating frame between a first, operative position where said guard rail assembly can be raised or collapsed and a second, inoperative position wherein said lower rail with said rail assembly in its collapsed position is stored under the side rail of said elevating frame; and releasable looking means on said elevating frame for locking said end plates with said rail assemblies in either of said positions.

7. A bed according to claim 1 wherein said gatch members comprise a series of panels extending transversely of said elevating frame; a first, head gatch panel and a third, knee gatch panel being pivotally mounted at their ends to said elevating frame; operating arms extending downwardly from said first and third panels; and separate actuating means connected to said arms for individually raising or lowering said panels.

8. A bed according to claim 7 wherein a fourth gatch panel is pivotally connected to said third panel for operating in unison therewith.

9. A bed according to claim 7 wherein the actuating means for said first panel is a hydraulic cylinder and the operating means for said third gatch panel is a manually rotated series of interconnected drive shafts; one of said shafts having a threaded outer surface with a captive nut thereon, said nut being pivotally mounted in the lower end of said third panel operating arms.

10. A bed according to claim 1 wherein said frame elevating means comprises two pairs of lifting arm units, one pair adjacent each end of said bed.

11. A variable height bed for use in hospitals and like facilities; said bed comprising:

a) a stationary frame having a castor foot adjacent each corner thereof;

b) an elevating frame interconnected with said stationary frame and moveable in elevation with respect to said stationary frame;

c) frame elevating means for effecting vertical movement of said elevating frame relative to said stationary frame and including linking means operable by said frame elevating means and interconnecting said stationary frame and said elevating frame, said elevating means providing movement of said elevating frame and a lowermost elevation position of approximately ten inches above a supporting surface to an uppermost elevation position of approximately twenty nine inches above said supporting surface;

d) means operable at any elevation of said elevating frame for immobilizing said bed against movement on said supporting surface;

e) head and knee gatch members detachably secured to the upper surface of said elevating frame and means for actuating said head and knee gatch members to angularly elevated or flat positions with respect to said upper surface;

f) a guard rail assembly secured along each side of said elevating frame, each guard rail assembly comprising a lower rail secured to said elevating frame and an upper rail spaced therefrom and parallel thereto, with a plurality of upright members interconnecting said upper and lower rails;

g) means for diagonally collapsing said upper rail and upright members down onto said lower rail member; and means for pivoting said collapsed guard rail assembly from a position adjacent the side edge of said elevating frame to a position beneath said side edge;

h) said stationary frame and said elevating frame each having longitudinal, parallel side rails and end rails; the side rails of said elevating frame being spaced inwardly of the side rails of the stationary frame; and a pair of strut members extending downwardly from said elevating frame adjacent each end thereof; said frame elevating means comprising two pairs of lifting arm units, one pair adjacent each end of said bed; each lifting unit comprising:

(i) a torsion tube extending transversely of the longitudinal axis of said bed and mounted for rotation in a pair of said strut members;

(ii) a pair of lift arms, one at each end of said torsion tube, said arms extending angularly upwardly and means at their upper ends for engaging the side rails of said stationary bed frame;

(iii) at least one torque arm mounted on said torsion tube and extending angularly upwardly therefrom; and (iv) actuating means mounted to said elevating frame at one of its ends and longitudinally extending rod means connecting its other end to said torque arm of said lifting units, whereby, operation of said actuating means in one direction causes said torsion tube and its associated torque arm and lifting arms to rotate in said strut members, raising said elevating frame above said stationary frame; and operating said actuator in the opposite direction lowers said elevating frame;

(v) said connecting rod means extending centrally of said elevating frame and passing through the cross members thereof whereby nesting of said stationary and elevating frames are substantially enhanced.

12. A bed according to claim 11 including a pair of torque arms on each torsion tube adjacent the center thereof, said actuating means comprising a hydraulic cylinder, the piston rod end of which is connected to said torque arms.

13. A bed according to claim 11 wherein the means at the upper end of each said lift arm comprises an outwardly directed pin member; a roller mounted on said pin members on the arms at one end of the structure and resting on the rail of said stationary frame; and bearing plates on said rails of said stationary frame at the other end of said structure and receiving the pin members of the arms at said other end.

14. A bed according to claim 11 wherein said immobilizing means comprises a pair of stationary leg members on each side of said stationary frame and located inwardly of the ends thereof and spaced from adjacent castor means, said leg member falling short of the support surface;

a foot pivotally secured to each leg member of each pair thereof, a series of link members interconnecting each said foot with actuating lever means which, when operated, effects pivoting said foot downwardly into contact with the supporting surface to raise the bed and the castors above the supporting surface.

15. A bed according to claim 11 wherein each said guard rail assembly includes the upright members being pivotally mounted at their lower ends to the outside of said lower rail member and, at their upper ends, pivotally secured between flanges depending from said upper rail member; a diagonal strut interconnecting the end upright member with a movable slider on said lower rail member, and means on said slider and said lower rail for detachably locking said slider in two positions on said lower rail, one said position locking the assembly in an upright, operative position and the other position to collapse the upper rail onto the lower rail in a "down" position.

16. A bed according to claim 15 including means for moving said collapsed assembly to a stored position under said elevating frame, comprising an end place secured to each end of said lower rail, each end plate being pivotally mounted to an end rail of said elevating frame; each said end plates being rotatable about its pivotal connection to said elevating frame between a first, operative position where said guard rail assembly can be raised or collapsed and a second, inoperative position wherein said lower rail with said rail assembly, in its collapsed position is stored under the side rail of said elevating frame; and releasable locking means on said elevating frame for locking said end plates with said rail assemblies in either of said positions.

17. A bed according to claim 11 wherein said gatch members comprise a series of panels extending transversely of said elevating frame; a first, head gatch panel and a third, knee gatch panel being pivotally mounted at their ends to said elevating frame; operating arms extending downwardly from said first and third panels; and separate actuating means connected to said arms for individually raising or lowering said panels.

18. A bed according to claim 17 wherein a fourth gatch panel is pivotally connected to said third panel for operating in unison therewith.

19. A bed according to claim 17 wherein the actuating means for said first panel is a hydraulic cylinder and the operating means for said third gatch panel is a manually rotated series of interconnected drive shafts; one of said shafts having a threaded outer surface with a captive nut thereon, said nut being pivotally mounted in the lower end of said third panel operating arms.

* * * * *